US007970320B2

(12) United States Patent
Hong et al.

(10) Patent No.: US 7,970,320 B2
(45) Date of Patent: Jun. 28, 2011

(54) IMAGE FORMING APPARATUS HAVING CHARGING DEVICE USING MAGNETIC BRUSH CHARGER

(75) Inventors: Yukwi Hong, Mishima (JP); Koichi Hashimoto, Mishima (JP); Ryota Matsumoto, Suntou-gun (JP); Shingo Horita, Suntou-gun (JP); Ryo Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 244 days.

(21) Appl. No.: 12/337,647

(22) Filed: Dec. 18, 2008

(65) Prior Publication Data

US 2009/0162100 A1 Jun. 25, 2009

(30) Foreign Application Priority Data

Dec. 20, 2007 (JP) ..... 2007-328710
Nov. 6, 2008 (JP) ..... 2008-285505

(51) Int. Cl.
*G03G 15/02* (2006.01)

(52) U.S. Cl. ..... 399/175; 399/100; 399/115; 399/168; 399/172; 399/174; 399/176

(58) Field of Classification Search ..... 399/100, 399/115, 168, 172, 174, 175, 176
See application file for complete search history.

(56) References Cited

U.S. PATENT DOCUMENTS

2004/0265005 A1* 12/2004 Suzuki et al. ..... 399/168
2005/0238369 A1* 10/2005 Nakano et al. ..... 399/27

FOREIGN PATENT DOCUMENTS

JP 2-21591 5/1990
JP 2003-330270 11/2003

* cited by examiner

*Primary Examiner* — Ryan D Walsh
(74) *Attorney, Agent, or Firm* — Canon USA Inc IP Division

(57) ABSTRACT

An image forming apparatus includes an image bearing member and a charging device configured to charge the image bearing member. The charging device includes a magnetic particle carrier and a magnetic particle regulating member configured to regulate magnetic particles carried by the magnetic particle carrier. The charging device causes the magnetic particles carried by the magnetic particle carrier to contact the image bearing member, and applies a voltage to the magnetic particle carrier to charge the image bearing member. An electrode has a contact area via which the electrode can contact magnetic particles stored in a particle pool defined by the magnetic particle carrier and the magnetic particle regulating member. The contact area is variable according to an amount of the magnetic particles stored in the particle pool. A current detection device detects a value of current flowing from the magnetic particle carrier to the electrode via the magnetic particles.

17 Claims, 21 Drawing Sheets

FIG.4

| FILLING AMOUNT OF MAGNETIC PARTICLES [g] | 20 | 30 | 40 | 50 | 60 | 70 | 80 |
|---|---|---|---|---|---|---|---|
| AGENT SURFACE (RELATIVE TO REGULATING PORTION) [mm] | 4 | 7 | 11 | 15 | 19 | 21 | 23 |
| STATE OF MAGNETIC PARTICLES COATED ON SLEEVE | × | △ | ○ | ○ | △ | × | × |

IMAGE FORMING APPARATUS HAVING CHARGING DEVICE USING MAGNETIC BRUSH CHARGER

BACKGROUND OF THE INVENTION

1. Field of the Invention

The present invention relates to an image forming apparatus including a charging device using a magnetic brush charging method.

2. Description of the Related Art

There are many image forming apparatuses referred to as an electrophotographic type or an electrostatic recording type, which are conventionally proposed. FIG. 1 illustrates a representative configuration of a conventional image forming apparatus. An operation of the image forming apparatus is simply described below with reference to FIG. 1.

The image forming apparatus illustrated in FIG. 1 includes a corona charger 3 for a photosensitive drum 1 that has a predetermined potential at the surface thereof when a copy start signal is input. An integral unit 9, including a document illumination lamp, a short focal lens array, and a charge-coupled device (CCD) sensor, irradiates a document G on a document placing glass plate 10 with light to perform scanning. The light reflected from the document surface (i.e., part of the irradiated scanning light) reaches the CCD sensor via the short focal lens array that forms an image of the document on the CCD sensor.

The CCD sensor includes a light-receiving portion, a transfer portion, and an output portion. The light-receiving portion converts light incident on the CCD sensor into an electric charge signal. The transfer portion successively transfers the electric charge signal from the light-receiving portion to the output portion in synchronism with a clock pulse. The output portion converts each electric charge signal into a voltage signal, and outputs an amplified and impedance-reduced analog signal to an external device. The analog signal thus obtained is subjected to conventional image processing to produce a digital signal and is transferred to a printer unit. The printer unit includes a light emitting diode (LED) exposure unit 2 configured to selectively emit light in response to an image signal and form an electrostatic latent image corresponding to a document image on a surface of a photosensitive drum 1.

A development unit 4 accommodating toner particles is configured to develop the electrostatic latent image and obtain a toner image on the photosensitive drum 1. The development unit 4 coats a developer on a development sleeve 41 accommodating magnet rollers in its inner space. The development unit 4 includes a power source (not illustrated) capable of applying a development bias to develop toners on the photosensitive drum 1. A transfer device 7 electrostatically transfers the toner image formed on the photosensitive drum 1 to a transfer member. Then, the transfer member is electrostatically separated and conveyed to a fixing unit 6 configured to output a thermally fixed image.

After the toner image transfer operation is completed, a cleaner 5 removes the toners not transferred and remaining on the surface of the photosensitive drum 1. The cleaner 5 can also remove any contaminant substances from the surface of the photosensitive drum 1. If necessary, the surface of the photosensitive drum 1 is exposed to light from a pre-exposure lamp 8 serving as a pre-exposure unit configured to remove an image exposure light memory so that the photosensitive drum 1 can be repetitively used for image formation.

The corona charging method is generally used for the above-described image forming process, i.e., for an electrophotographic image forming apparatus. However, enthusiastic study and development are recently performed for the contact charging method that can reduce an amount of ozone products (i.e., discharge products) and can operate at a lower power level. And, there are some contact charging systems already used.

The contact charging method is a charging method for charging a photosensitive member by causing a charging member to contact the photosensitive member and applying a voltage to the charging member. A magnetic brush charging device using a magnetic brush as a contact charging member is a representative charging device using the above-described method. The magnetic brush charging device is advantageous in that charging contact is stabile.

The magnetic brush charging device can magnetically hold conductive magnetic particles directly on a surface of a magnet, or on a surface of a sleeve accommodating a magnet, and can cause the magnetic particles to contact a surface of a photosensitive member and apply a voltage to charge the photosensitive member. When the magnetic brush charging device is used to charge a photosensitive member having a surface layer including diffused conductive fine particles on a conventional organic photosensitive member, or an amorphous silicon photosensitive member, the charging operation can be performed using a charging potential substantially equivalent to a DC component of a bias applied to the magnetic brush. This charging method is hereinafter referred to as a magnetic brush injection charging method.

The magnetic brush injection charging method does not use any discharge phenomenon similar to that used in the corona charging method, in a charging operation for a photosensitive member. Accordingly, an ozoneless and low-power consuming charging operation can be realized. Flow of an image derived from a discharge product does not appear even in a high-humid environment.

Compared to the organic photosensitive member, the amorphous silicon photosensitive member has a higher hardness and a long life. The running cost of a product can be reduced. As understood from the above description, a combination of the magnetic brush injection charging method and the amorphous silicon photosensitive member can realize an image forming system excellent in both durability and stability.

However, according to the magnetic brush injection charging method, conductive magnetic particles stored in a charging container are subjected to abrasion on their surfaces, electric breakdown, and inclusion of foreign particles entering the magnetic brush (e.g., a developer entering via a cleaning blade). Therefore, electric properties and powder properties of the magnetic particles change during a long-term use.

More specifically, the property of a coat on a sleeve gradually deteriorates due to an increase in the resistance and a change in the flowability of the magnetic particles. The above-described deteriorations occurring in the magnetic particles are inevitable. Therefore, a user is required to perform a replacement work for replacing the magnetic particles at appropriate timing during a long-term use of an image forming apparatus.

Similar deteriorations in conductive magnetic particles are recognized in a two-component development method. The two-component development method is a widely used conventional development method applicable to an electrophotographic image forming apparatus, particularly to an image forming apparatus performing chromatic image forming processing, according to which a mixture of non-magnetic toners and magnetic particles (development carrier) is used as a developer. Similar deterioration is recognized in the developer.

When the agent (e.g., charging magnetic particles or developer) is deteriorated, an agent replacement operation is performed. In the agent replacement operation, it is not so difficult to always equalize a discharge amount of a discharge unit discharging the deteriorated agent with a replenishment amount of a replenishment unit replenishing a new agent. However, the discharge amount and the replenishment amount may not be identical if the discharge amount varies or if replenishment accuracy deteriorates.

In a two-component development device performing discharge and replenishment of the developer, if a discharge amount of the developer is larger than a replenishment amount of a new developer, the developer surface in a development unit gradually lowers. If the developer decreases greatly, no developer can be supplied to a development sleeve.

On the contrary, if the discharge amount of the developer is less than the replenishment amount of a new developer, an excessive amount of developer may be supplied to the development sleeve or part of the developer may leak out of the development unit.

There are some conventional methods capable of solving the above-described problems in the two-component development method. For example, as discussed in Japanese Patent publication No. 2-21591, a development apparatus usable for an electrophotographic copying machine includes a developer discharge unit and a developer replenishment unit, including an agitating unit agitating carriers and toners and a development roller supplying the developer agitated by the agitating unit to a photosensitive member. A carrier replenishment apparatus and a toner replenishment apparatus are provided, separately or integrally, above the agitating unit. A developer overflow portion is provided on a sidewall of the development apparatus. Therefore, while the replenishment apparatus replenishes a new developer by degrees, excessive developer can be discharged from the developer overflow portion. The developer in the development apparatus can maintain constant properties. As a result, printed products can possess constant image quality.

More specifically, the apparatus replenishes the developer while regulating the particle surface level in an agitating region to gradually replace the deteriorated developer with new developer, thereby preventing the agent from deteriorating and stabilizing the properties. The apparatus does not require any work for replacing the developer and can realize an improved maintenance operation.

As discussed in Japanese Patent Application Laid-Open No. 2003-330270, there is another method for discharging carriers using a fogging removal potential so as to develop the carriers transferred from a development sleeve to a photosensitive member in a non-image region on the photosensitive member and supplying the developer to the development sleeve in a region other than the region where the carriers are discharged.

The development particle surface level in the agitating region is generally set to a height sufficient to supply the developer in the entire range of the development sleeve in the longitudinal direction. Therefore, the developer is supplied to the carrier discharge region on the development sleeve. The carriers adhere to the photosensitive member at a development nip portion, and a carrier discharge operation is performed. However, if the development particle surface level in the agitating region is lower than a predetermined height, the developer is not supplied to the development sleeve only in the carrier discharge region. Therefore, no carriers can be discharged at the development nip portion. Therefore, the lower movement of the development particle surface is stopped. The predetermined height of the development particle surface is a height where the developer cannot be supplied to the development sleeve in any region other than the carrier discharge region.

Namely, the development particle surface can be regulated to a constant level in an area where the magnetic force can act from the development sleeve to a developer agitating region. As described above, the development apparatus using the two-component agent including toners and carriers can regulate the height of the particle surface level using the gravity in the developer agitating region where no magnetic force acts from development sleeve, because the development apparatus includes the agitating unit agitating the toners and the carriers. Furthermore, the development apparatus can hold a constant amount of developer. Accordingly, the development apparatus does not require any work for replacing the developer and can realize an improved maintenance operation. The development apparatus can stably adjust the amount of the developer with a simple configuration.

However, compared to the above-described two-component development device configured to agitate toners and carriers, the magnetic brush charging device is not required to agitate the agent. The magnetic force of the charging sleeve acts on almost all of the magnetic particles. The above-described method for regulating the particle surface by the gravity cannot be used. If a region where no magnetic force acts is necessary, it is required to provide an additional area. Furthermore, an agitating member is required to uniformly set the particle surface in the longitudinal direction.

If the magnetic brush charging device employs a conventional carrier replacement unit widely used for two-component development apparatuses, it is required to provide an agitating mechanism and secure a sufficient space. The cost and the size of the apparatus increase. Moreover, even in a case where the agitating mechanism is provided, accurately controlling the height of the particle surface level is desired.

SUMMARY OF THE INVENTION

Exemplary embodiments of the present invention are directed to a charging device using a magnetic brush charging method, which is capable of accurately detecting the height of the surface of magnetic particles.

According to an aspect of the present invention, an image forming apparatus includes an image bearing member; a charging device configured to charge the image bearing member, wherein the charging device includes a magnetic particle carrier and a magnetic particle regulating member configured to regulate magnetic particles carried by the magnetic particle carrier, wherein the charging device causes the magnetic particles carried by the magnetic particle carrier to contact the image bearing member, and applies a voltage to the magnetic particle carrier to charge the image bearing member; an electrode disposed in the charging device and having a contact area via which the electrode can contact magnetic particles stored in a particle pool defined by the magnetic particle carrier and the magnetic particle regulating member, wherein the contact area is variable according to an amount of the magnetic particles stored in the particle pool; and a current detection device configured to detect a value of current flowing from the magnetic particle carrier to the electrode via the magnetic particles.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

FIG. 4 is a table illustrating an observation result of a coated state relative to a magnetic particle filling amount according to the first exemplary embodiment.

DETAILED DESCRIPTION OF THE EMBODIMENTS

Figure 1:
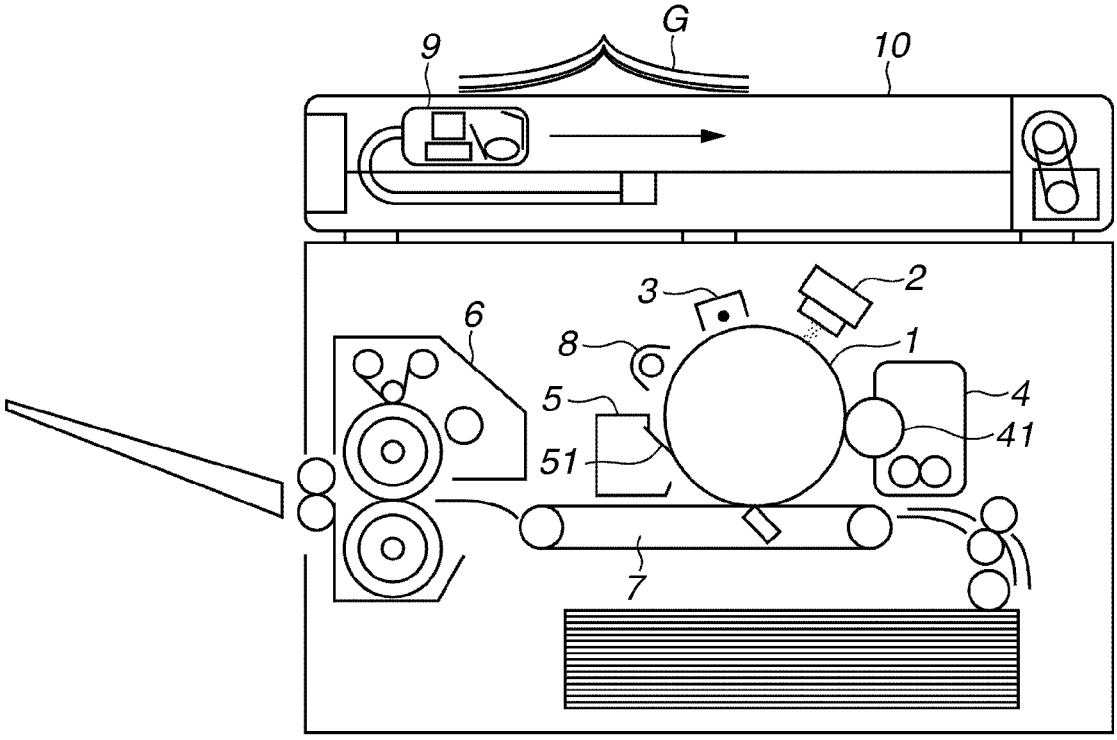
FIG.1 PRIOR ART
FIG. 1 illustrates a conventional image forming apparatus.

The following description of exemplary embodiments is illustrative in nature and is in no way intended to limit the invention, its application, or uses. It is noted that throughout the specification, similar reference numerals and letters refer to similar items in the following figures, and thus once an item is described in one figure, it may not be discussed for following figures. Various exemplary embodiments, features and aspects will be described in detail below with reference to the drawings.

Figure 2:
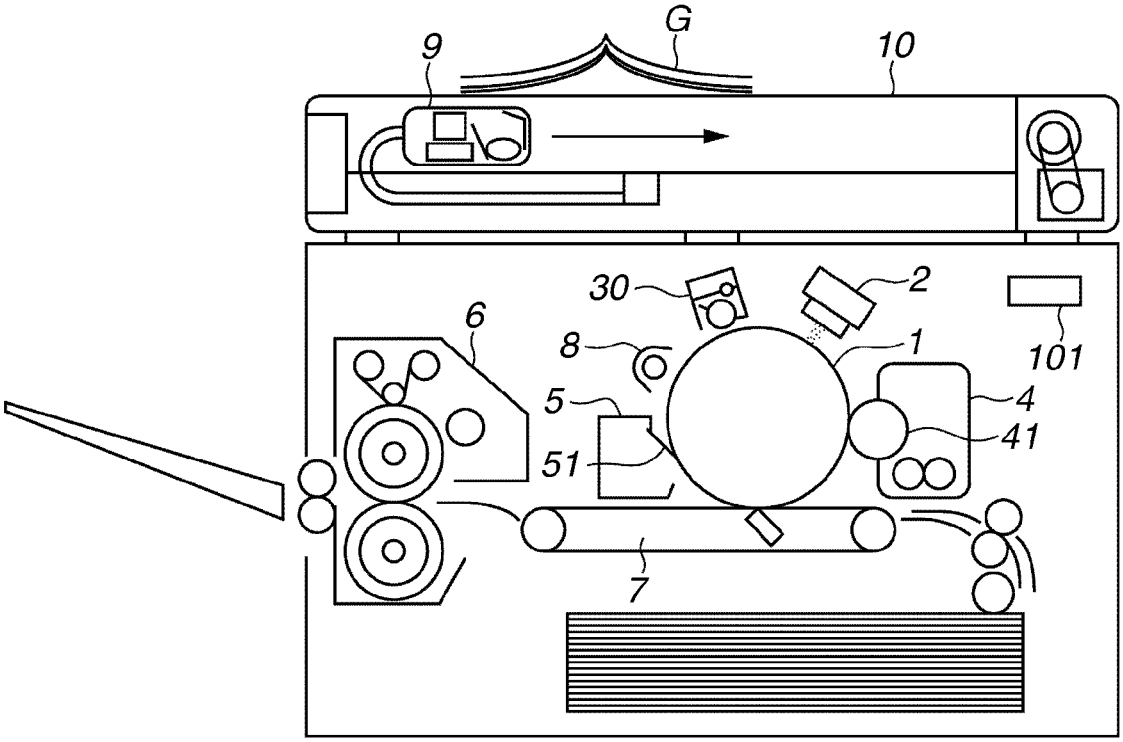
FIG. 2 illustrates an example image forming apparatus according to a first exemplary embodiment.

FIG. 2 illustrates an example image forming apparatus according to a first exemplary embodiment of the present invention. The image forming apparatus according to the present exemplary embodiment is different from the conventional image forming apparatus illustrated in FIG. 1 in that the corona charger 3 is replaced by a magnetic brush charger 30 having a configuration illustrated in FIG. 3 and serving as a charging device of a photosensitive member. A negative charging a-Si group photosensitive drum can be used as an image bearing member.

The negative charging a-Si group photosensitive drum used in the present exemplary embodiment is a photosensitive drum including an aluminum conductive support member having a diameter of 80 mm, on the surface of which a positive charge prevention layer, a photoconductive layer, a negative charge prevention layer, and a surface protection layer are successively laminated.

The photosensitive drum 1 has a diameter of 80 mm and can rotate at a rotational speed of 300 mm/sec. A charging sleeve 31 can rotate at a rotational speed of 200 mm/sec. In other words, a charging operation was performed at a relative speed of 500 mm/sec. The pre-exposure lamp 8 is an LED having a wavelength of 660 nm, which can emit light of approximately 370 Lux.sec. to expose the surface of the photosensitive drum 1.

The development unit 4 coats a developer on the development sleeve 41 in which the magnet rollers are provided. The development unit 4 includes a power source (not illustrated) capable of applying a development bias to develop toners on the photosensitive drum 1. The developer includes negative charging toners having a particle diameter of approximately 7 μm and magnetic particles (for development use) having a particle diameter of approximately 35 μm. The development sleeve 41 and the photosensitive drum 1 can rotate in the same direction. When the development sleeve 41 rotates, its peripheral speed reaches approximately 450 mm/sec.

The transfer device 7 electrostatically transfers the toner image formed on the photosensitive drum 1 to a transfer member. Then, the transfer member is electrostatically separated and conveyed to the fixing unit 6 configured to output a thermally fixed image. After the toner image transfer operation is completed, the cleaner 5 removes the toners not transferred and remaining on the surface of the photosensitive drum 1. The cleaner 5 can also remove any contaminant substances from the surface of the photosensitive drum 1. If necessary, the surface of the photosensitive drum 1 is exposed to light from the pre-exposure lamp 8 to remove an image exposure light memory so that the photosensitive drum 1 can be repetitively used for image formation. The cleaner 5 includes a urethane cleaning blade 51 having a thickness of 2 mm. The cleaning blade 51 scrapes the remaining toners off the photosensitive drum 1.

Figure 3:
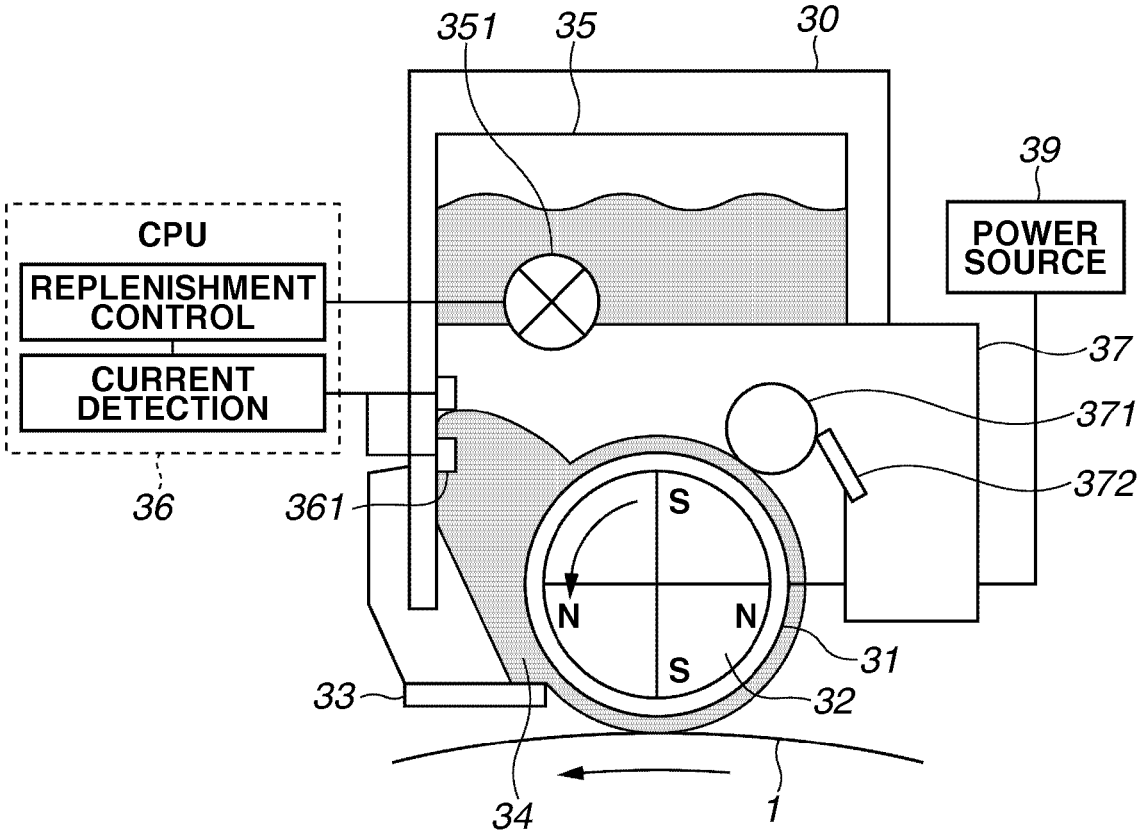
FIG. 3 illustrates an example magnetic brush charging device according to the first exemplary embodiment.

FIG. 3 illustrates an example configuration of the magnetic brush charger 30. The magnetic brush charger 30 includes the charging sleeve 31 including a stationary magnet 32. The charging sleeve 31 is a rotary non-magnetic member serving as a magnetic particle carrier. Under application of a magnetic field, charging magnetic particles 34 are formed on the charging sleeve 31 so as to have a brush-like shape. A regulating blade 33, serving as a magnetic particle regulating member, regulates the thickness of a layer of the magnetic particles 34 formed on the charging sleeve 31. The charging sleeve 31 can convey the charging magnetic particles 34 while it rotates.

The magnet 32 accommodated in the charging sleeve 31 includes a pole S1 facing the photosensitive drum 1 and having a magnetic flux density of approximately 90 mT because of the following reasons. If the magnetic flux density at a portion facing the photosensitive drum 1 is smaller than 50 mT, the magnetic particles 34 may move to the surface of the photosensitive drum 1 against a magnetic force of the magnet. This phenomenon is generally referred to as "carrier adhesion." Accordingly, it is desired that the magnetic flux density is equal to or greater than 70 mT. If the magnetic flux density is greater than 130 mT, a large frictional force acts on the magnetic particles 34 when sliding relative to the photosensitive drum 1. The magnetic particles 34 may abrade or damage a surface protection layer of the photosensitive drum 1. It is therefore desired that the magnetic flux density is equal to or less than 110 mT.

A clearance between the regulating blade 33 and the charging sleeve 31 is set to be 300 μm. The regulating blade 33 is disposed on the upstream side of a confronting portion where the charging sleeve 31 and the photosensitive drum 1 are opposed. More specifically, in the rotational direction of the charging sleeve 31, the regulating blade 33 is spaced by an advanced angle of 45° from the confronting portion between the charging sleeve 31 and the photosensitive drum 1.

The charging sleeve 31 has an outer diameter of 20 mm. The charging sleeve 31 rotates in a direction opposed to the rotational direction of the photosensitive drum 1. When a power source 39 applies a charging voltage to the charging sleeve 31, electric charges are given from the magnetic particles 34 to the photosensitive drum 1. The charged surface of the photosensitive drum 1 has an electric potential corresponding to the charging voltage.

In the present exemplary embodiment, the applied charging voltage is equal to a sum of DC-500V and a rectangular AC bias of 1 kHz and 300 Vpp. The clearance being set between the charging sleeve 31 and the photosensitive drum 1 is equal to 350 μm. It is desired that the magnetic particles 34 have an average particle diameter in a range of 10 to 100 μm, a saturation magnetization in a range of 20 to 250 emu/$cm^3$, and a resistance in a range of $1\times10^2$ to $1\times10^{10}$ Ω·cm.

To improve the electrostatic chargeability, it is desired to use the magnetic particles 34 having a lower resistance. However, considering the presence of pinholes that deteriorate insulation properties of the photosensitive drum, it is desired that the resistance of the magnetic particles 34 is equal to or greater than $1\times10^6$ Ω·cm. The present exemplary embodiment performs a resistance adjustment by applying an oxidation-reduction treatment to ferrite surfaces and additionally performs a coupling treatment. More specifically, the present exemplary embodiment uses charging magnetic particles having an average particle diameter of 35 μm, a saturation magnetization of 200 emu/$cm^3$, a resistance of $5\times10^6$ Ω·cm, a specific gravity of 4.7 g/$cm^3$, and a relative permeability of 2.4. The initial filling amount for the magnetic brush charger 30 is set to 50 g.

The resistance value of the magnetic particles 34 used in the present exemplary embodiment can be measured by placing charging magnetic particles of 2 g in a metallic cell having a bottom area of 2, 28 $cm^2$, adding a load of 1 kg/cm2, and applying a voltage of 100V.

An example method for discharging the magnetic particles is described below with reference to FIG. 3. The magnetic brush charger 30 includes a discharging device 37 (magnetic particle discharging device) as illustrated in FIG. 3. The discharging device 37 includes a collection sleeve 371 and a scraper 372 which are substantially brought into contact with each other. More specifically, a clearance of 500 μm is set between the collection sleeve 371 and the charging sleeve 31 in the present exemplary embodiment.

When no voltage is applied to the charging sleeve 31 (such as a non-image formation area), the power source applies a rectangular pulse voltage to the collection sleeve 371. In response to the pulse voltage applied to the collection sleeve 371, a sharp potential difference is instantaneously generated at a contact point between the collection sleeve 371 and a magnetic brush. An electrostatic force acts on the magnetic particles 34 in the vicinity of the contact point. The electrostatic force causes the magnetic particles 34 to adhere to the collection sleeve 371. The collection sleeve 371 collects the magnetic particles 34 from the charging sleeve 31.

The scraper 372 removes the magnetic particles 34 from the collection sleeve 371 and scraps the collected magnetic particles 34. It is desired that the pulse voltage applied to the collection sleeve 371 is in a range of 100 V to 1 kV in absolute value. If the pulse voltage is smaller than 100V, the discharge amount of the charging agent becomes smaller or the charging agent may not be discharged. If a large discharge amount is required, it is desired that the absolute value of the pulse voltage is larger. However, considering adverse effects caused by electric discharge, it is appropriate to set the pulse voltage applied to the collection sleeve 371 to 1 kV or less.

The present exemplary embodiment applies a voltage of −500V with a pulse width of 100 msec, and can discharge the magnetic particles 34 of 60 mg each time on the photosensitive drum 1. As another method for discharging magnetic particles, it is possible to directly move the scraper close to the charging sleeve 31 to remove the magnetic particles. It is apparent that similar effects can be obtained.

An example method for controlling the supply amount of the magnetic particles 34 is described below with reference to FIG. 3. The magnetic brush charger 30 includes a supply device 35 serving as a magnetic particle supply device. The supply device 35 includes an accommodation chamber storing new (unused) magnetic particles, a supply port, and a supply screw 351 provided at the supply port. A charging chamber including the charging sleeve 31 is separated from the accommodation chamber by a partition wall.

The supply screw 351 supplies new magnetic particles from the accommodation chamber to the charging chamber via the supply port provided between them. The supply amount of the magnetic particles is roughly determined according to the number of revolutions of the supply screw 351. In the present exemplary embodiment, the supply screw 351 can supply charging magnetic particles of approximately 300 mg while it makes one complete revolution. A control device determines the number of rotations of the supply screw 351.

A central processing unit (CPU) 36 is a control device that can control the amount of magnetic particles supplied to the photosensitive drum 1. The CPU 36 can also serve as a current detection device, which detects current flowing from the charging sleeve 31 to a detection electrode 361 via the magnetic particles. The CPU 36 identifies the amount of magnetic particles 34 stored in a circulation portion (referred to as "particle pool") corresponding to the entry to the regulating blade 33 and determines the number of revolutions of the supply screw 351. The particle pool is a space defined by the regulating blade 33 and the charging sleeve 31 in the charging chamber.

The detection electrode 361 is a copper tape, which is fixed to an upper portion of the wall surface defining the particle pool and can detect current flowing through the magnetic particles. In the present exemplary embodiment, the detection electrode 361 is a copper tape having a thickness of 300 μm.

The detection electrode 361 is provided at a position where the area of the detection electrode 361 contacting the magnetic particles is variable depending on the amount of the magnetic particles stored in the particle pool. The position of the detection electrode 361 is not specifically limited to the illustrated position if the detection electrode 361 can satisfy the above-described requirement.

In a case where the gravity of the magnetic particles is used to supply the magnetic particles to the particle pool via the supply port, it is desired that the detection electrode 361 is positioned on the upstream side of the regulating blade 33 and on the downstream side of the supply port in the rotational direction of the charging sleeve 31. In a charging operation, a charging bias is applied to the charging sleeve 31. If the detection electrode 361 contacts the magnetic particles, a current flows from the charging sleeve 31 via the magnetic particles to the detection electrode 361. No current flows before the detection electrode 361 contacts the magnetic particles 34.

In the present exemplary embodiment, the detection electrode 361 includes two rectangular electrodes respectively used for current detection and positioned at different altitudinal levels in the up-and-down direction. Each rectangular electrode has a vertical size of 2 mm and a horizontal size of 5 mm. The number of the detection electrodes contacting the magnetic particles is variable depending on the amount of the magnetic particles stored in the particle pool.

Figure 18:
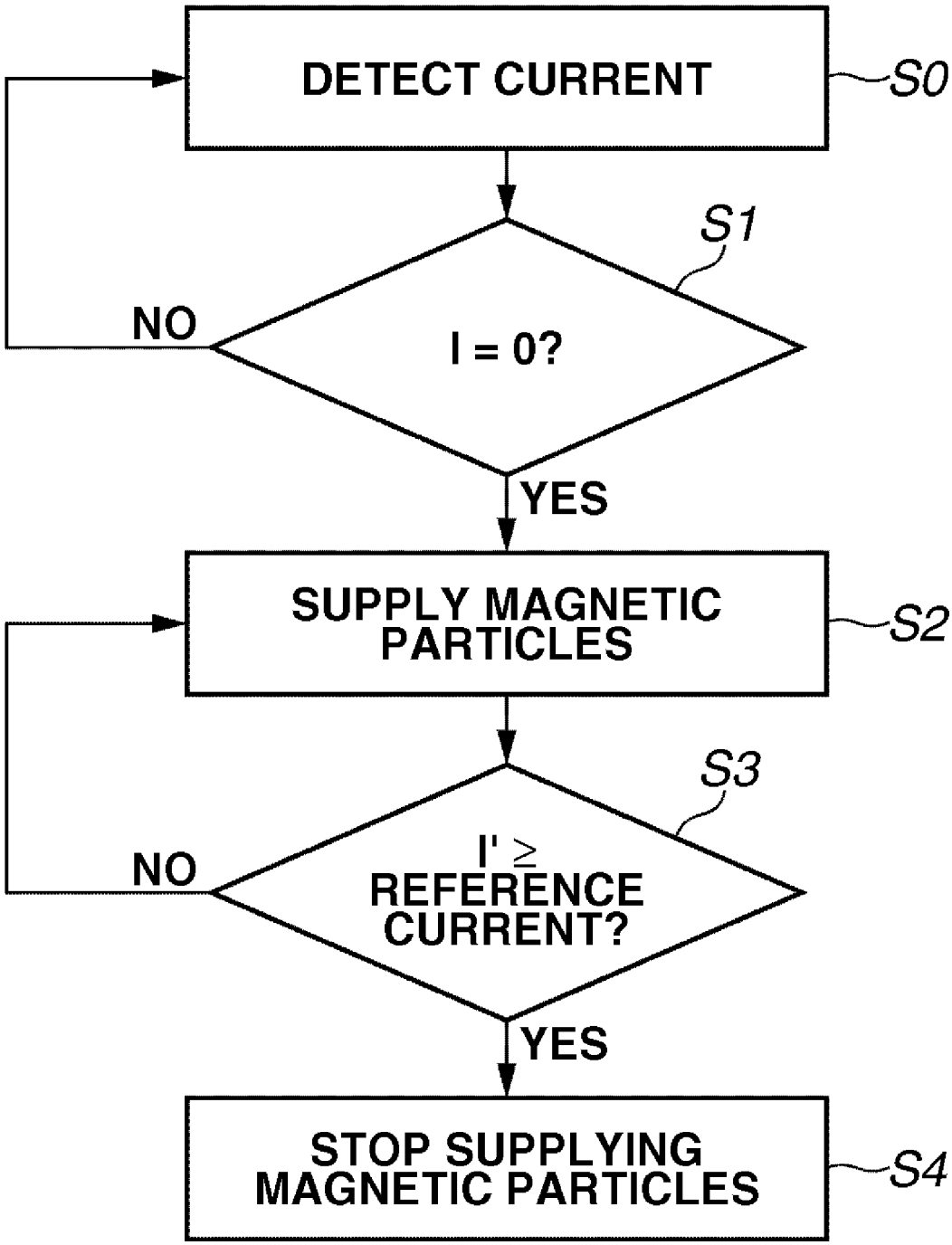
FIG. 18 is a flowchart illustrating example control processing according to the first exemplary embodiment.

When a bias is applied to the charging sleeve 31 during a charging operation, the amount of the magnetic particles stored in the particle pool is constantly detected. An example method for supplying the magnetic particles includes causing the supply screw 351 to start rotating when the lower electrode does not detect any current due to reduction in the amount of the magnetic particles stored in the particle pool, and causing the supply screw 351 to stop rotating when the upper electrode detects an increased amount of the magnetic particles newly stored in the particle pool. FIG. 18 is a flowchart illustrating example control processing for supplying magnetic particles.

In step S0, the CPU 36 detects a current I. In step S1, the CPU 36 determines whether the current I flowing through the lower detection electrode is equal to 0. If the current I becomes 0 (YES in step S1), the processing proceeds to step S2. In step S2, the CPU 36 performs a magnetic particle supplying operation. In step S3, the CPU 36 determines whether a current I' flowing through the upper detection electrode is equal to or greater than a reference current. If the current I' is equal to or greater than the reference current (YES in step S3), the processing proceeds to step S4. In step S4, the CPU 36 stops the magnetic particle supplying operation.

In the present exemplary embodiment, when the detected current is equal to or greater than 0.4 mA (reference current), the CPU 36 determines that the magnetic particles 34 are detected. The reference current, serving as a reference used in the control of a discharge/supply operation, is stored in a non-volatile memory 101 (storage medium). The present exemplary embodiment uses two detection circuits for the upper and lower electrodes. Each detection circuit includes a resistance of 1 kΩ to measure a voltage value representing the current flowing through the electrode and an A/D converter to obtain current data to be read by the CPU 36.

To determine the setup positions of the upper and lower electrodes, an experiment was conducted to determine an appropriate amount of magnetic particles. In the experiment, the particle surface level of the particle pool and the state of the magnetic particles 34 coated on the charging sleeve 31 were observed while changing the amount of the magnetic particles 34 filled in the magnetic brush charger 30. As illustrated in FIG. 4, when the amount of the conductive magnetic particles is less than 20 g, the amount of magnetic particles is insufficient and the sleeve may not be covered with the magnetic particles. If the amount of the conductive magnetic particles is greater than 70 g, the magnetic particles 34 are clogged in the region of the particle pool and the coated surface may become defective. In FIG. 4, A represents a range where the coated surface is not uniform and unstable although the defective coat may not occur. More specifically, it is desired that the position of the particle surface level relative to a regulating portion of the regulating blade 33 is in a range of 10 mm to 15 mm.

Accordingly, the setup positions of two (upper and lower) detection electrodes 361 was determined to be 15 mm and 10 mm higher than the regulating portion of the regulating blade 33. Through the experiment, it was confirmed whether the reduction in the charged potential during a long-time charging operation can be prevented and the defective coat can be eliminated by performing the operation for replacing the magnetic particles 34.

Figure 5:
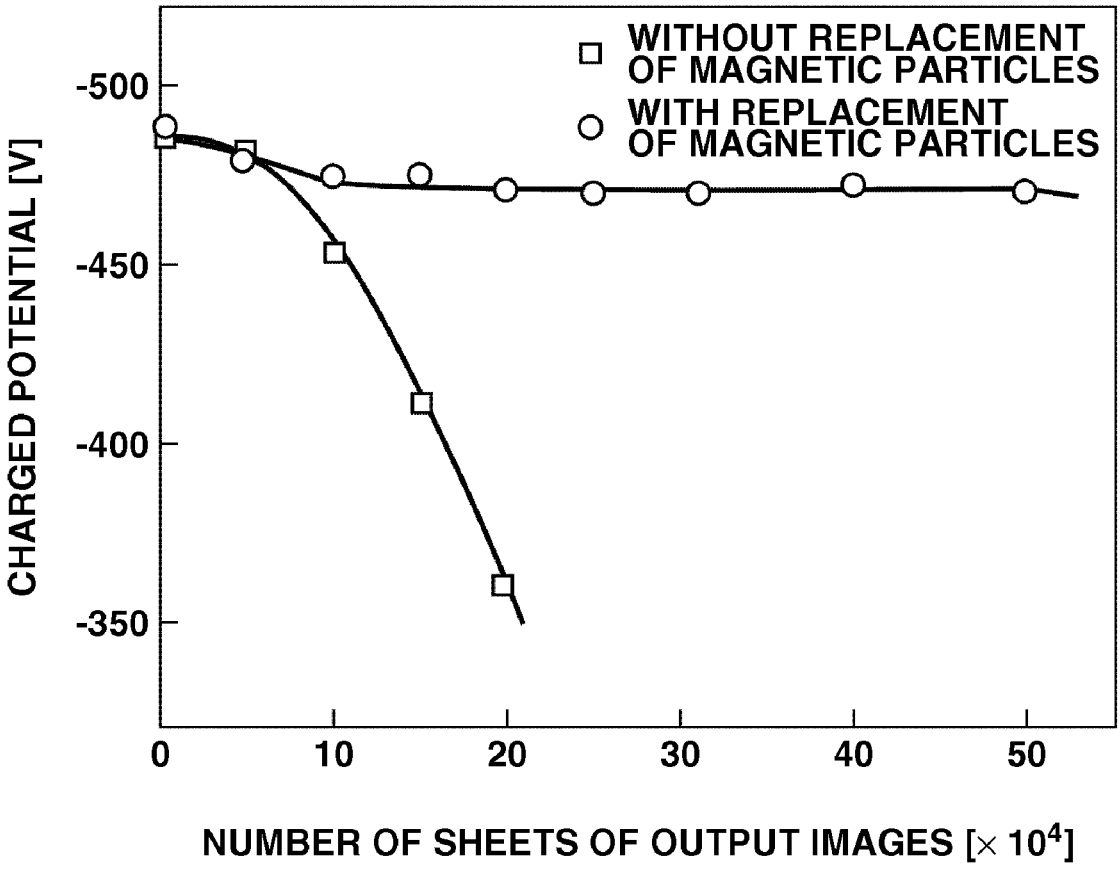
FIG. 5 is a graph illustrating an experimental result obtained for confirming effects according to the first exemplary embodiment.

FIG. 5 illustrates a change in the charged potential observed when printing of an image having a printing rate of 10% was performed for a long time without replacing the magnetic particles 34 in comparison with a change in the charged potential observed when the magnetic particle discharge/supply operation was performed for every 100 sheets according to the present exemplary embodiment.

When the printing of images was continuously performed for a long time without replacing the magnetic particles 34, a charged potential reduction corresponding to approximately 10% of the initial potential was confirmed at the timing the number of output sheets reached $1\times10^4$. The confirmed reduction in the charged potential possibly influences the quality of a printed image.

On the other hand, when the discharge/supply operation was performed for every 100 sheets of output images, the charged potential was maintained at substantially the constant level even after the number of output sheets reached $1\times10^5$ and non-occurrence of the defective coat was confirmed.

The discharge operation can be performed based on the current flowing through the detection electrode. For example, the discharge operation can be performed continuously until the current flowing through the lower detection electrode stops. Then, the supply operation can be started. When the current flowing through the upper detection electrode is detected, the discharge operation can be resumed.

As described above, the present exemplary embodiment can stably adjust the filling amount of the magnetic particle without requiring a complicated mechanism, i.e., using a simple configuration, in a limited space. Compared to the two-component developer containing insulating toners, the particle surface level of magnetic particles can be detected by detecting the current flowing through a detection electrode via the magnetic particles.

In the first exemplary embodiment, the reference current was set to be equal to a detected current of 0.4 mA. Detection of the current was determined based on only a comparison with the reference current. The current flowing thought the detection electrode is variable depending on the area of a surface where the detection electrode can contact the magnetic particles. Accordingly, by monitoring the change in the current flowing through the detection electrode, the filling amount of the magnetic particles can be more accurately detected.

Figure 6:
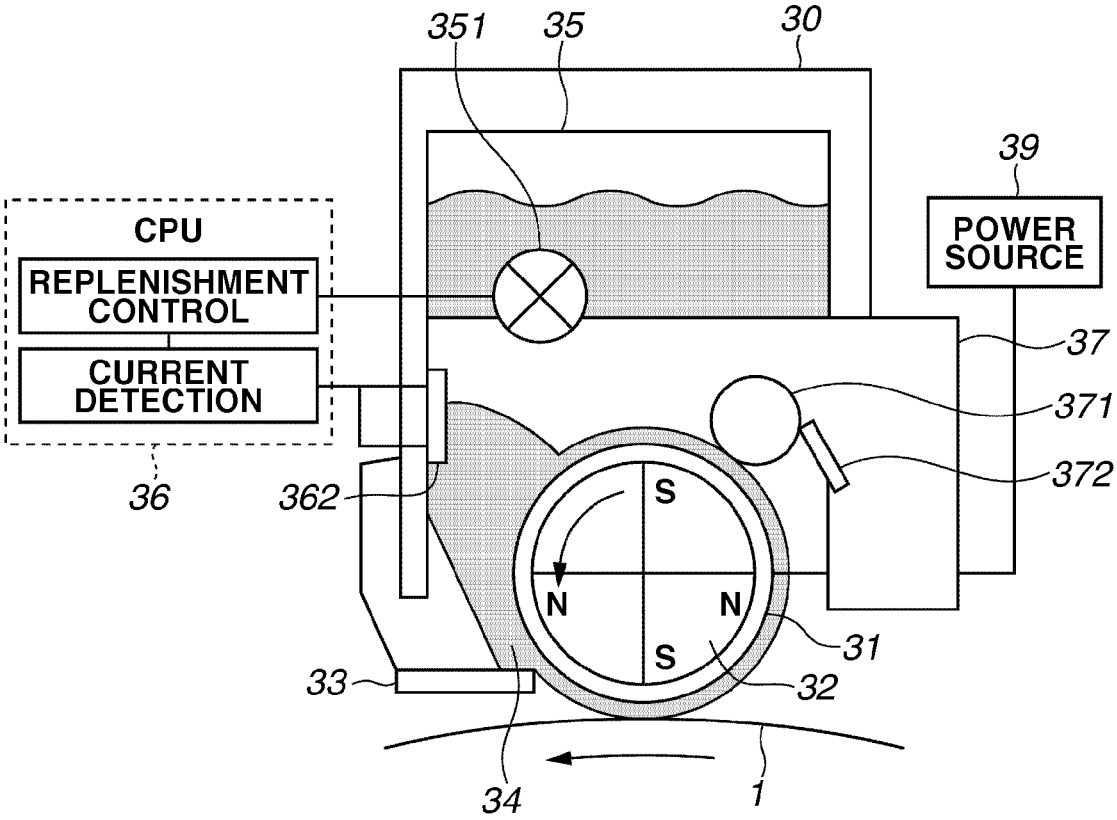
FIG. 6 illustrates an example magnetic brush charging device according to a second exemplary embodiment.

A second exemplary embodiment of the present invention uses only one electrode 362 extending in the up-and-down direction in the particle pool as illustrated in FIG. 6, instead of using two (upper and lower) electrodes described in the first exemplary embodiment. The second exemplary embodiment can realize a continual detection based on the current representing the amount of magnetic particles presently stored in the particle pool.

In the present exemplary embodiment, the detection electrode 362 is a rectangular electrode having a vertical size of 12 mm and a horizontal size of 5 mm. The detection electrode 362 has an upper end positioned 19 mm higher than the regulating portion of the regulating blade 33 and a lower end positioned 7 mm higher than the regulating portion of the regulating blade 33. As described in the first exemplary embodiment, to stabilize the coated state, it is desired that the particle surface level of the magnetic particles, when stored in the particle pool, is positioned at the height of 10 mm to 15 mm relative to the regulating portion. Therefore, the detection electrode 362 is required to cover the designated altitudinal range.

The present exemplary embodiment prepares two (first and second) reference current values. If the detected current becomes smaller than the first reference current due to reduction in the amount (volume) of the magnetic particles stored in the particle pool, the control device starts a charging agent supplying operation. If the detected current becomes greater than the second reference current, the control device stops the supplying operation.

Figure 19:
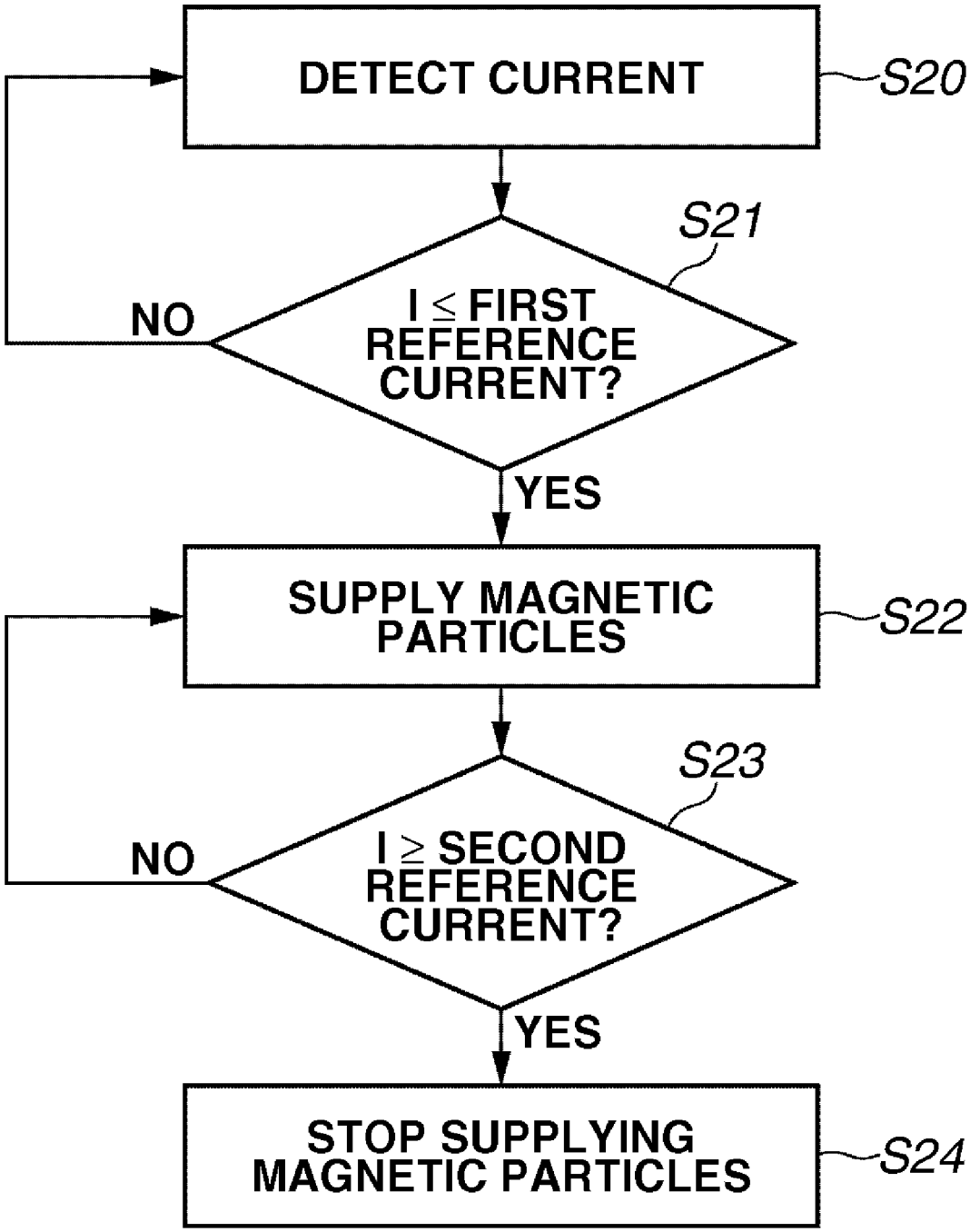
FIG. 19 is a flowchart illustrating example control processing according to the second exemplary embodiment.

FIG. 19 is a flowchart illustrating example control processing for supplying magnetic particles. In step S20, the CPU detects a current I. In step S21, the CPU 36 determines whether the current I flowing through the detection electrode is equal to or less than the first reference current. If the current I is equal to or less than the first reference current (YES in step S21), the processing proceeds to step S22. In step S22, the CPU 36 performs a magnetic particle supplying operation.

In step S23, the CPU 36 determines whether the current I flowing through the detection electrode is equal to or greater than the second reference current. If the current I is equal to or greater than the second reference current (YES in step S23), the processing proceeds to step S24. In step S24, the CPU 36 stops the magnetic particle supplying operation.

Figure 7:
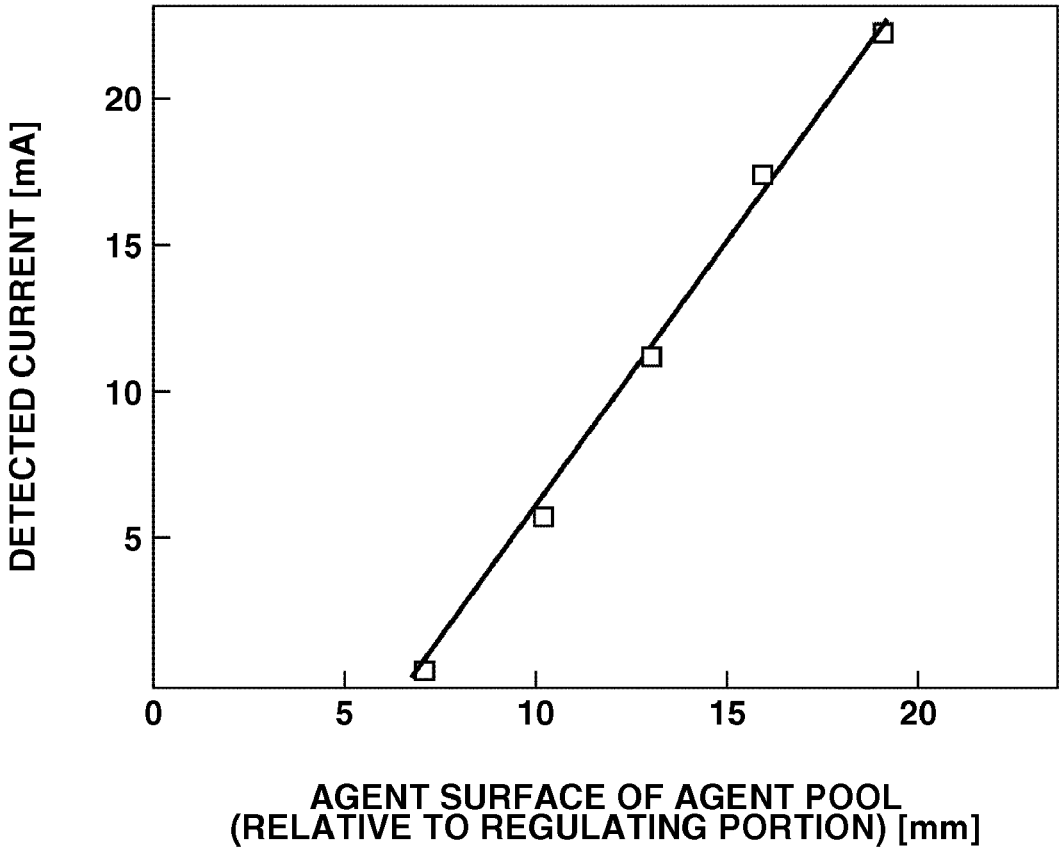
FIG. 7 is a graph illustrating a detected current varying according to a change of a particle surface level of magnetic particles according to the second exemplary embodiment.

In the present exemplary embodiment, an experiment was conducted to measure a change in the detected current according to a variation of the particle surface level in the particle pool. FIG. 7 illustrates a result of the experiment. Similar to the first exemplary embodiment, to position the particle surface level somewhere in the range of 10 mm to 15 mm from the regulating portion, the present exemplary embodiment sets upper and lower limits of the reference current to 6 mA and 16 mA, respectively. Therefore, the present exemplary embodiment can control the height of the particle surface level in a region where the coated state is stable.

Figure 8A:
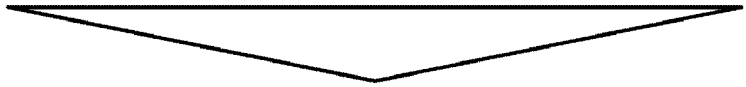
FIGS. 8A to 8C illustrate example electrodes used for detecting the amount of magnetic particles stored in a particle pool according to the second exemplary embodiment.
Figure 8B:
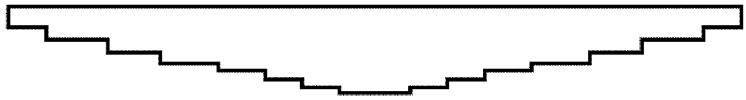
Figure 8C:
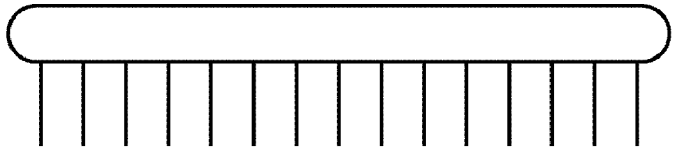

The second exemplary embodiment using the above-described method can read the current using a single detection circuit, although the first exemplary embodiment requires two detection circuits. FIGS. 8A to 8C illustrate example shapes of the electrode according to the present exemplary embodiment, according to which the electrode can be configured to be a reversed triangular shape, can be stepped along lower sides and gradually widen, or can be configured to be dense in the upper region. Thus, the present exemplary embodiment can realize a current detection sensitive to a variable topmost surface (particle surface level) of the particles stored in the particle pool.

Figure 9:
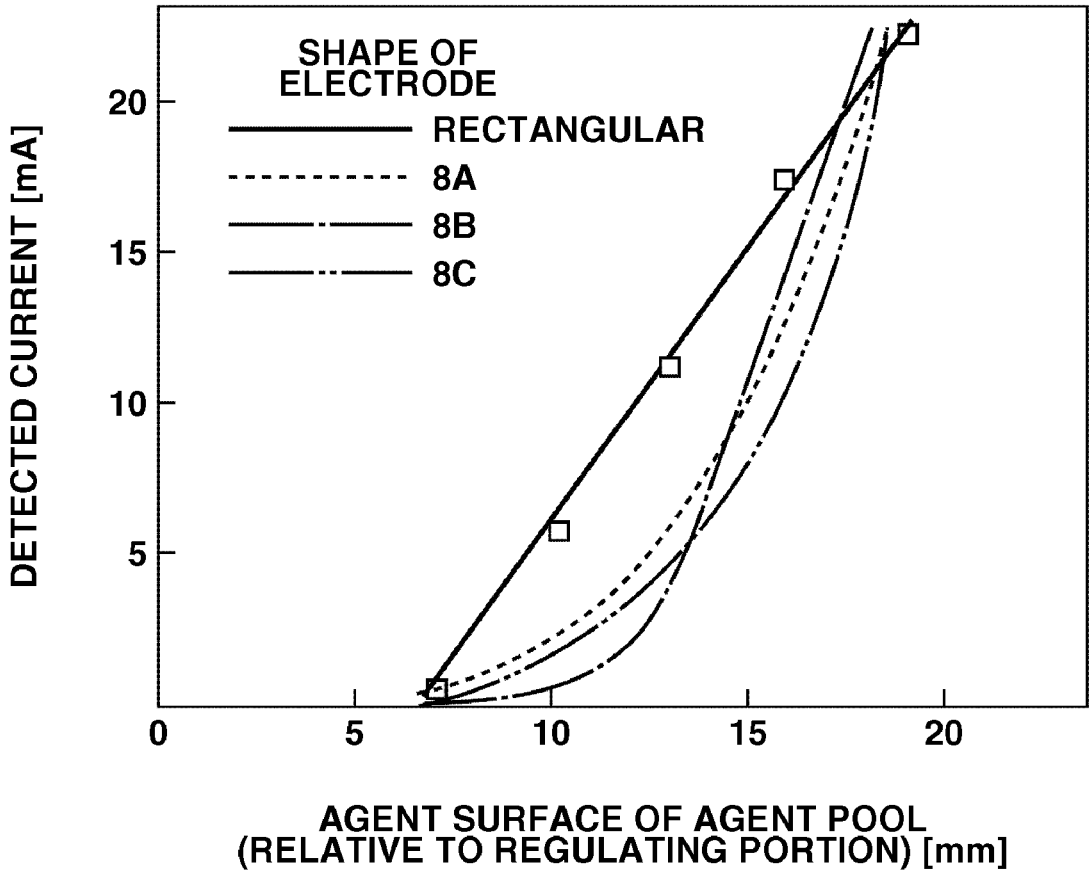
FIG. 9 is a graph illustrating currents detected by various electrodes according to the second exemplary embodiment.

More specifically, the length of the electrode in the horizontal direction at a position corresponding to the particle surface level in a case where a larger amount of magnetic particles is stored in the particle pool is set to be longer than the length of the electrode in the horizontal direction at a position corresponding to the particle surface level in a case where a smaller amount of magnetic particles is stored in the particle pool. Therefore, as illustrated in FIG. 9, the present exemplary embodiment can realize a current detection sensitive to a variable particle surface level and can realize a sensitive supply amount control.

For example, according to the rectangular electrode used in an exemplary embodiment, to position the particle surface level in the appropriate range of 10 mm to 15 mm, the reference current is set to be a value in the range of 6 mA to 16 mA. On the other hand, when the triangular electrode illustrated in FIG. 8A is used, it is understood that the particle surface level moves in a narrow range of 13 mm to 16 mm while the current changes in the same range of 6 mA to 16 mA. Therefore, the detected current varies largely in response to a change of the particle surface level. If the particle surface level is out of the appropriate region, the current value changes greatly. Therefore, a precise detection operation can be realized.

Any other electrodes having various shapes can be used. Various particle surface detection controls can be realized by using electrodes having continuously or intermittently varying electrode areas.

Figure 10B:
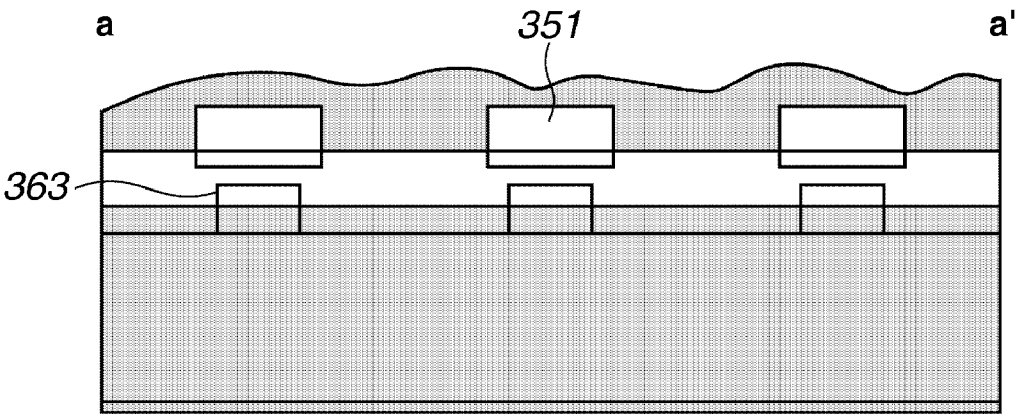
FIGS. 10A and 10B illustrate an example magnetic brush charging device according to a third exemplary embodiment.
Figure 10A:
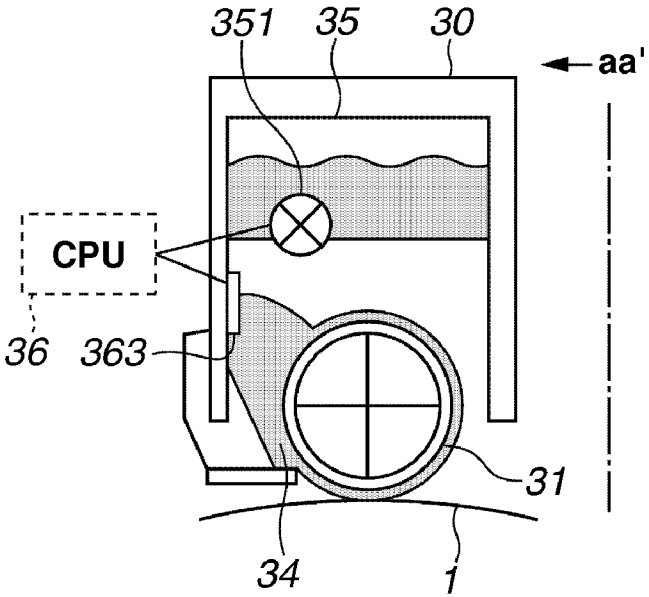

A third exemplary embodiment of the present invention uses a supplying unit including a plurality of supply screws 351 described in the first and second exemplary embodiments and a detection device including a plurality of detection electrodes 363 disposed in the longitudinal direction of the charging sleeve 31 as illustrated in FIGS. 10A and 10B. The third exemplary embodiment can reduce the deviation of a particle pool amount in the longitudinal direction.

The supply device 35 includes a plurality of supply screws 351 disposed in the longitudinal direction. Each supply screw 351 is capable of transporting the agent. The number of revolutions of each supply screw 351 is determined according to a current flowing through a corresponding (associated) one of the electrodes 363 disposed in the longitudinal direction.

In the present exemplary embodiment, the plurality of detection electrodes 363 are disposed at the positions corresponding to respective supply screws 351. The number of revolutions of each supply screw 351 can be independently controlled based on a current flowing through an associated detection electrode 363.

In the present exemplary embodiment, three sets of the supplying device and the detection device described in the second exemplary embodiment are disposed at different (front, center, and rear) positions in the longitudinal direction. When the current detected by a detection device is equal to or less than 6 mA, the supplying screw corresponding to the detection device starts supplying magnetic particles. If the current exceeds 16 mA, the corresponding screw stops supplying the magnetic particles. By repeating the above-described operation, the third exemplary embodiment can hold the particle surface level in the range of 10 mm to 15 mm from the regulating portion, similar to the first and second exemplary embodiments. Furthermore, the third exemplary embodiment can reduce the deviation in the filling amount of magnetic particles in the longitudinal direction.

In the present exemplary embodiment, the supply amount of magnetic particles in the longitudinal direction can be changed. The above-described method can maintain the filling amount of the magnetic particles at a constant level and can eliminate the deviation of a particle pool amount in the longitudinal direction.

A fourth exemplary embodiment of the present invention uses an additional detection unit configured to detect a comparative current when the resistance of the magnetic particles 34 changes and correct the current (reference current) used for detecting the amount of particles stored in the particle pool in the first to third exemplary embodiments.

The resistance of magnetic particles may vary due to deterioration in their properties or inclusion of foreign particles during a repetitive use for formation of images, or when used in different environments. The operations according to the first to the third exemplary embodiments are effective if a resistance change of the magnetic particles does not give any influence on the current flowing through the electrode that detects the amount of magnetic particles stored in the particle pool. However, when the resistance value of the magnetic particles changes greatly, if the current obtained from the detection electrode is directly used in the first to third exemplary embodiments, the magnetic particle filling amount may greatly deviate from a desired value.

Figure 11:
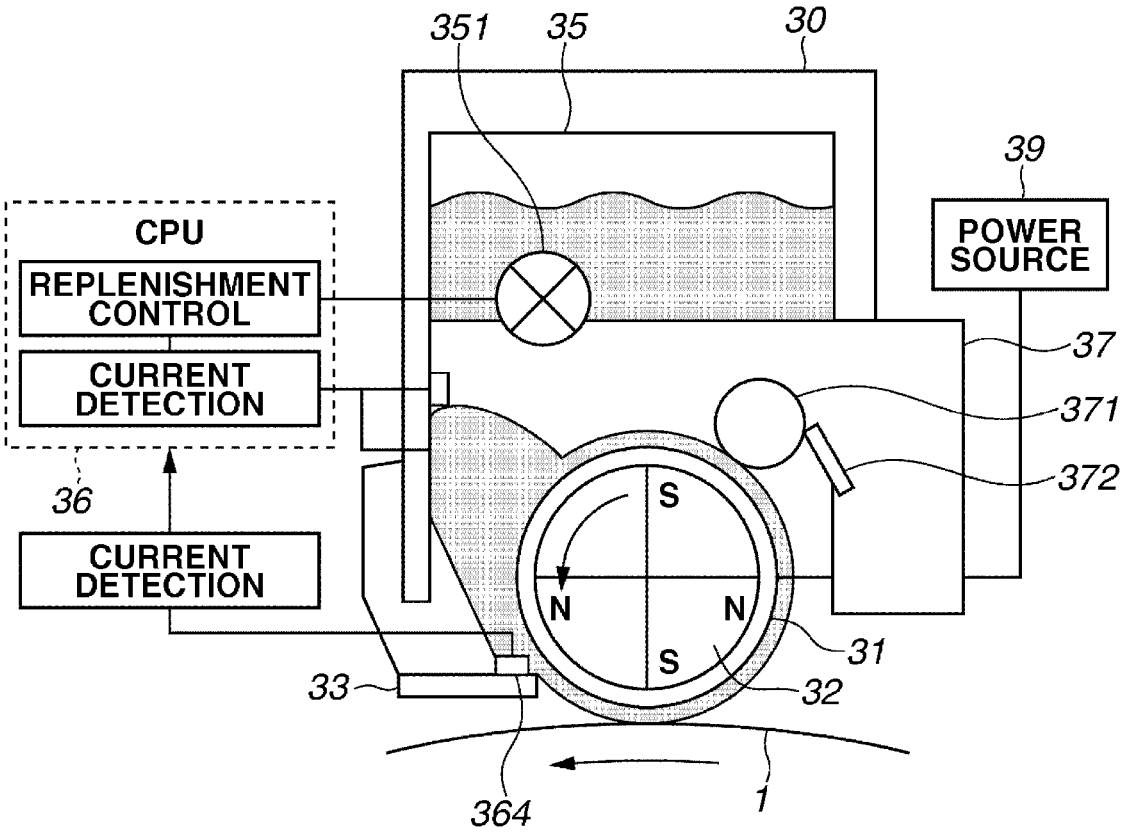
FIG. 11 illustrates an example magnetic brush charging device according to a fourth exemplary embodiment.

In the present exemplary embodiment, as illustrated in FIG. 11, another electrode 364 is newly disposed at a position where the electrode 364 can constantly and sufficiently contact the magnetic particles irrespective of variation in the amount of the magnetic particles. The electrode 364 can detect a comparative current corresponding to a resistance change of the magnetic particles. Thus, the control device can correct the reference current based on a change amount of the comparative current read by the electrode 364 and can accurately adjust the supply amount of the magnetic particles.

In the present exemplary embodiment, the detection electrode 364 (i.e., electrode exclusively used for correction) is a rectangular electrode having a size of 2.5 mm×2 mm and disposed on a surface of the regulating blade 33 where the detection electrode 364 can constantly contact the magnetic particles. If the magnetic particles are in an initial state, a current of 2 mA can be detected as the current flowing through the above-described electrode. The current threshold in the first exemplary embodiment is set to be 0.2 times the detected current (2 mA). The thresholds for the upper and lower limits of the reference current in the second and third exemplary embodiments are corrected to be three time and the eight times the detected current. According to the above-described settings, irrespective of a resistance change of the magnetic particles, information of the particle surface level can be accurately obtained.

For example, if the detected current for correction use decreases from 2 mA (initial value) to 1 mA (half value), the reference current of 6 mA to 16 mA determined in the second and third exemplary embodiments is newly corrected to be 3 mA to 8 mA. The magnetic particle supplying operation is controlled based on the new reference current.

Figure 20:
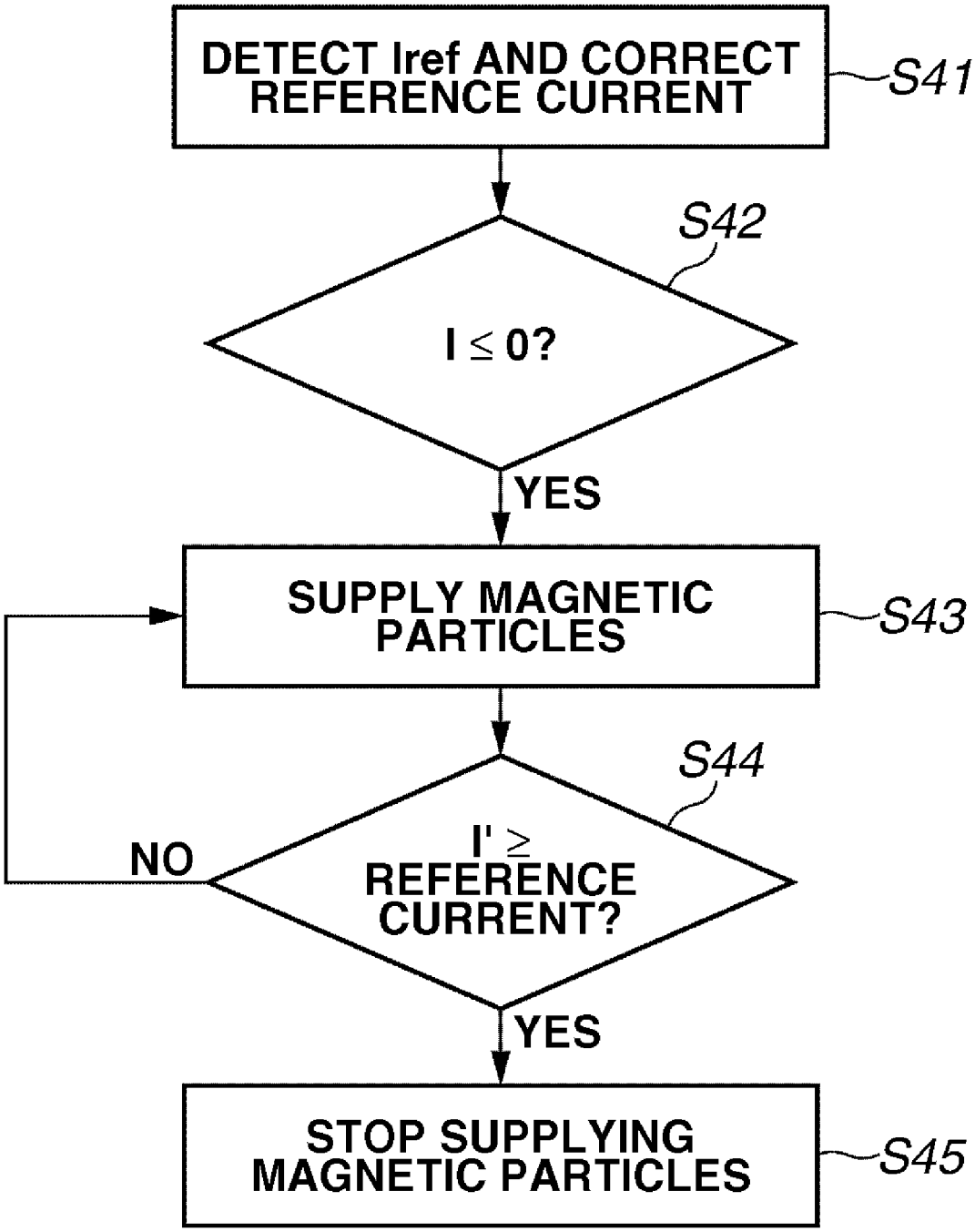
FIG. 20 is a flowchart illustrating example control processing according to the fourth exemplary embodiment.

FIG. 20 is a flowchart illustrating example control processing for supplying magnetic particles. In step S40, the CPU 36 detects the current flowing through a correction electrode and corrects the reference current. In step S41, the CPU 36 detects a current I. In step S42, the CPU 36 determines whether the current I flowing through the lower detection electrode is equal to 0. If the current I is equal to 0 (YES in step S42), the processing proceeds to step S43. In step S43, the CPU 36 performs a magnetic particle supplying operation.

In step S44, the CPU 36 determines whether the current I' flowing through the upper detection electrode is equal to or greater than the reference current. If the current I' is equal to or greater than the reference current (YES in step S44), the processing proceeds to step S45. In step S45, the CPU 36 stops the magnetic particle supplying operation.

By performing the above-described correction, the amount of the magnetic particles can be maintained at a constant level because the replacement operation can be intermittently performed without continuously discharging the magnetic particles when the resistance of the magnetic particles suddenly changes due to a disturbance.

Figure 12:
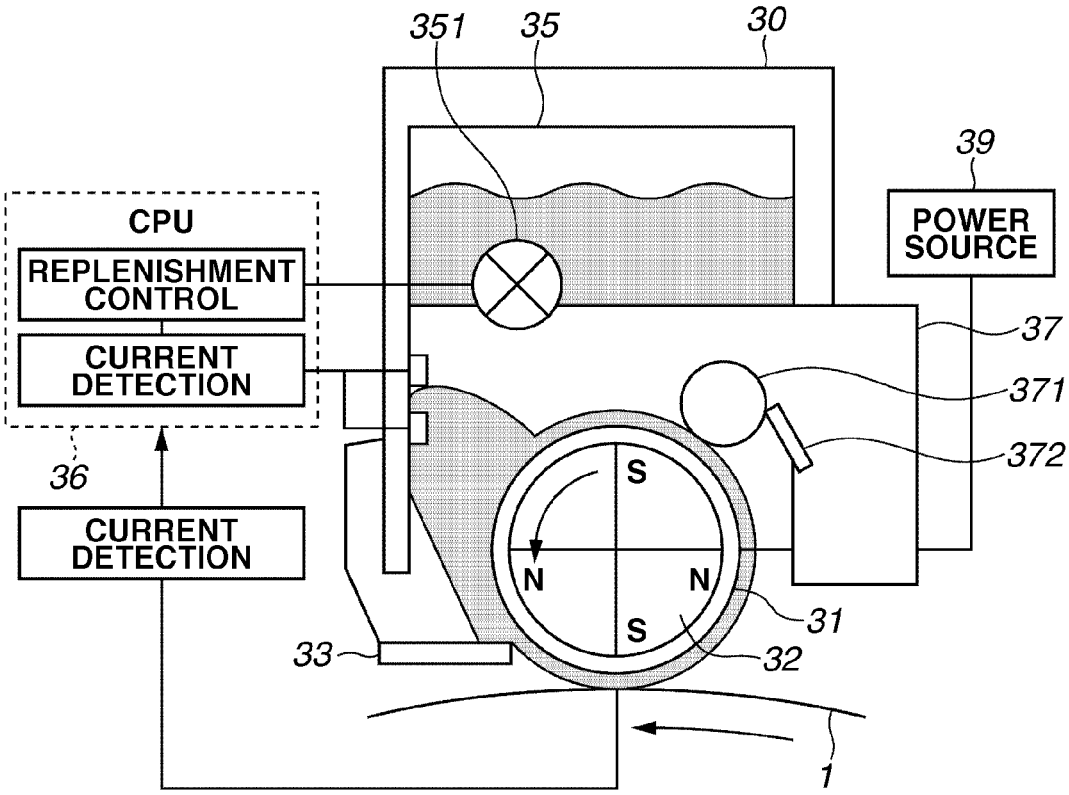
FIG. 12 illustrates the example magnetic brush charging device according to the fourth exemplary embodiment.

As an example method for measuring the resistance of magnetic particles, the current flowing from the charging sleeve 31 to the photosensitive drum 1 can be detected as illustrated in FIG. 12. The magnetic particles are constantly present in a space between the charging sleeve 31 and the photosensitive drum 1. The detected current can be used to estimate a resistance change of the magnetic particles.

The current flowing from the charging sleeve 31 to the photosensitive drum 1 may vary if the photosensitive drum 1 has a film thickness varying according to a cumulative operation time of the apparatus. Hence, in a case where the film thickness of the drum changes greatly, it is desired that the non-volatile memory 101 (storage medium) stores correction data beforehand to correct the current if the film thickness changes due to a long-term operation of the apparatus.

The first to fourth exemplary embodiments perform the operation for discharging and supplying magnetic particles at constant intervals. However, the deterioration level of the magnetic particles is variable depending on an operation status (e.g., image ratio) of the apparatus. Hence, an exemplary embodiment provides a method for adjusting a replacement frequency of the magnetic particles according to the deterioration level of the magnetic particles to minimize the resistance change of the magnetic particles. According to the method of the present exemplary embodiment, one electrode can be used to simultaneously detect the amount of the magnetic particles and the deterioration level of the magnetic particles.

The above-described first exemplary embodiment detects the amount of the magnetic particles 34 by determining whether the current detected by the detection electrode 361 becomes greater than the threshold. As illustrated in FIG. 3, the detection electrode 361 includes two (upper and lower) electrodes fixed on an upper wall surface of the particle pool. However, the resistance of the magnetic particles may change due to deterioration in their properties or inclusion of foreign particles during a repetitive use for formation of images, or when used in different environments.

Figure 15:
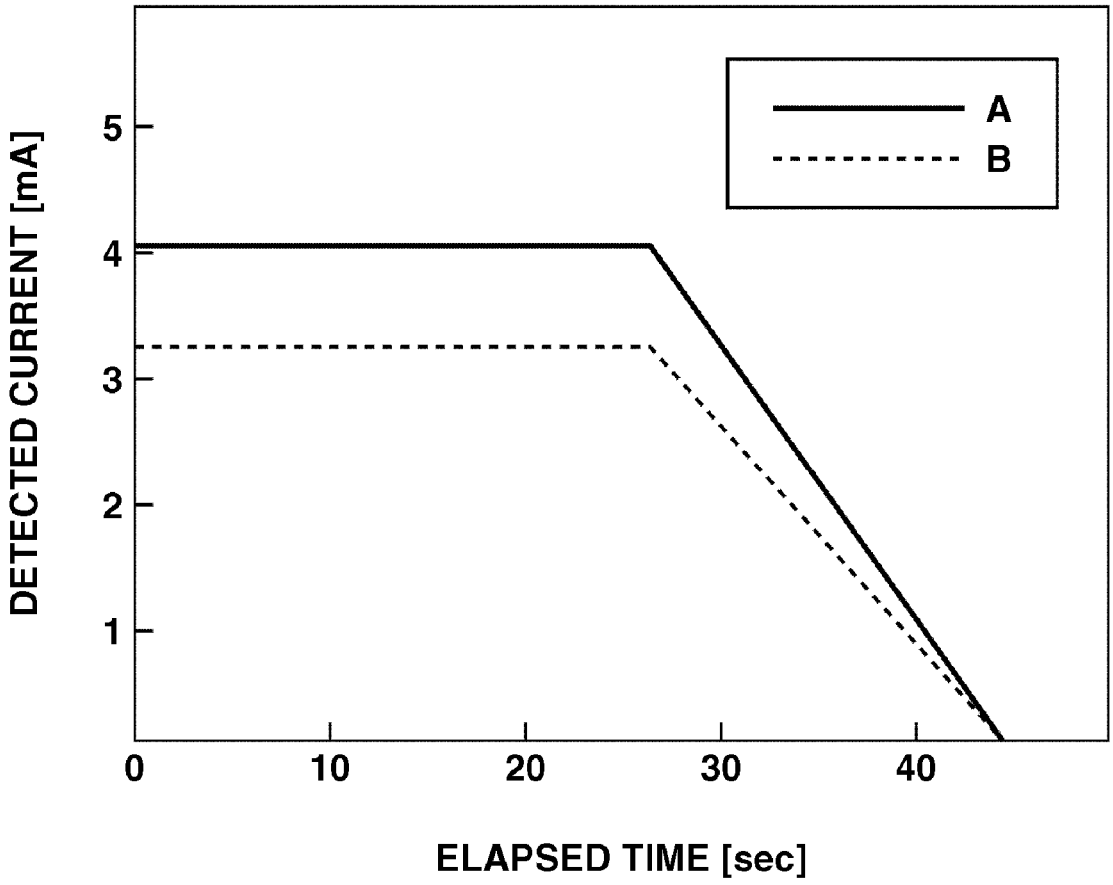
FIG. 15 is a graph illustrating currents detected in an ordinary discharge operation according to a fifth exemplary embodiment.

A fifth exemplary embodiment of the present invention can accurately set a desired filling amount and appropriately determine a replenishment amount by detecting a reduction rate of the detected current flowing through the detection electrode 361 when a discharge operation is performed at a predetermined speed. FIG. 15 illustrates a detection current flowing through the lower electrode when the magnetic brush charger 30 is filled with unused magnetic particles A of 50 g and a detection current flowing through the lower electrode when the magnetic brush charger 30 is filled with magnetic particles B of 50 g containing an additive agent increasing the resistance, in which a discharge operation is performed at a predetermined speed.

From FIG. 15, it is understood that the particle surface level is positioned on the lower electrode when a time of 27.3 seconds has elapsed after starting the discharge operation and no magnetic particle contacts the electrode when a time of 44.1 seconds has elapsed after starting the discharge operation. In a period of 27.3 to 44.1 seconds, the reduction rate of the current flowing through the magnetic particles A is different from the reduction rate of the current flowing through the magnetic particles B.

From the result illustrated in FIG. 15, it is understood that the current flowing through the magnetic particles B (having a higher resistance value) has a small reduction rate, i.e., a smaller absolute value in gradient, compared to the unused magnetic particles A, when the particle surface level of the magnetic particles moves across the electrode. The gradient can be used to determine a deterioration level of the magnetic particles. A current value read in a condition where the magnetic particle surface is sufficiently brought into contact with the electrode can be also used to determine the deterioration level of the magnetic particles.

However, in an actual image forming apparatus, the resistance value of the magnetic particles changes momentarily. It is therefore difficult to identify the cause of a current change between the deterioration of the magnetic particles and the variation of the magnetic particle surface level. Accordingly, by measuring the current value in a state where the magnetic particle surface level is surely changing in a discharge operation, the deterioration level of the magnetic particles can be determined while cancelling the effects caused by a movement of the magnetic particle surface level.

In the present exemplary embodiment, when a magnetic particle discharging device discharges magnetic particles, a current detection device (CPU) detects the current flowing through the detection electrode a plurality of times while the contact area between the electrode and the magnetic particles is changing. The CPU determines the next discharge timing of the magnetic particle discharging device according to a detected change amount of the current value. More specifically, the CPU samples current values at the intervals of 360 msec. and temporarily stores the sampled current values in a memory. When the current becomes zero, the CPU reads from the memory a current value detected 12.6 seconds before. The current value obtained by the above-described method can be used to correct reference current for detecting the magnetic particle surface level, as described in the fourth exemplary embodiment.

For example, it is now assumed that the current value detected 12.6 seconds before the detection of zero current is 3 mA if the magnetic particles are not deteriorated and is 2.7 mA if the magnetic particles are deteriorated. In this case, the CPU performs correction by multiplying the reference current value by 0.9 and detects the agent surface of the deteriorated magnetic particles based on the corrected reference current value. The CPU can perform similar processing for the upper and lower electrodes. In the present exemplary embodiment, the CPU reads a reduction rate of the current flowing through the lower electrode.

Furthermore, it is apparent that a change of an increasing current can be read when an ordinary replenishment is performed. For example, during a replenishment operation, the CPU can detect current values at different times while the contact area between the electrode and the magnetic particles is varying. The CPU can determine the next discharge/supply timing for the magnetic particles according to a change amount of the detected current.

The current value decrease during a period of 12.6 seconds is 3 mA if the unused magnetic particles are discharged at a constant speed. In this case, Ii represents a current reduction value during the period of 12.6 seconds when the unused magnetic particles are discharged at a constant speed. Ic represents a current reduction value during the period of 12.6 seconds when the deteriorated magnetic particles are discharged at a constant speed.

To attain a goal of suppressing a change of the current within 5%, it is necessary to adjust the replacement frequency of the magnetic particles so as to prevent the current reduction value Ic from becoming equal to or less than 2.85 mA. If image forming processing is performed at a lower printing rate, the current value does not change so greatly. Therefore, by decreasing the replacement frequency of the magnetic particles, the magnetic particles can be prevented from being excessively consumed.

On the other hand, if image forming processing is performed at a higher printing rate, it is required to replace the magnetic particles at a shorter interval (corresponding to a smaller number of sheets). In other words, the replacement frequency of the magnetic particle is required to be an appropriate value determined according to the printing rate (i.e., according to a state of contaminated magnetic particles).

Hence, a test was conducted to check the current reduction value Ic for respective printing rates 25%, 50%, and 100% during the above-described period of 12.6 seconds in an image output of 100 sheets. Furthermore, the number of printed sheets required for the current reduction value Ic to reach the allowable value of 2.85 mA was experimentally obtained for respective printing rates 25%, 50%, and 100%.

Experimental data of the current reduction value Ic obtained for respective printing rates 25%, 50%, and 100% in the image output of 100 sheets were 2.90 mA, 2.80 mA, and 2.62 mA. Experimental data of |Ii−Ic| were 0.10 mA, 0.20 mA, and 0.38 mA. The difference |Ii−Ic| is a variation width in a change of the detected current caused by the deterioration of the magnetic particles.

Figure 16:
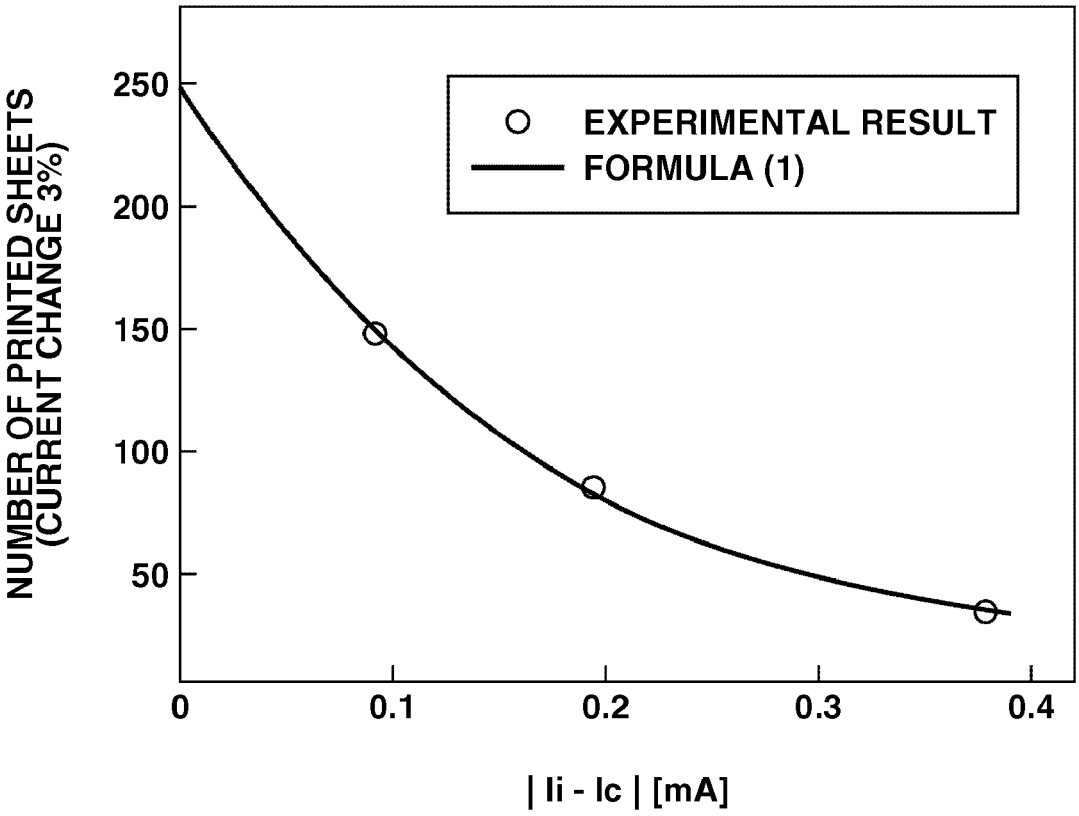
FIG. 16 is graph illustrating an appropriate replacement interval according to the fifth exemplary embodiment.

The number of printed sheets required for the current reduction value Ic to reach the allowable value of 2.85 mA was 150 sheets, 95 sheets, and 40 sheets for respective printing rates 25%, 50%, and 100%. FIG. 16 illustrates experimentally obtained data representing a relationship between the current change |Ii−Ic| in the image output of 100 sheets and the number of printed sheets required for the current reduction value Ic to reach the allowable value of 2.85 mA, for respective printing rates 25%, 50%, and 100%.

If the variation width |Ii−Ic| is large, the CPU can determine that the printing rate is large (i.e., a deterioration speed of the magnetic particles is large) and can allocate an appropriate replacement interval for the magnetic particles according to the identified deterioration speed. The following formula defines a magnetic particle replacement interval $P_{interval}$ (sheets) derived from the experimental results illustrated in FIG. 16.

$$P_{interval}(n+1)=250\times\exp(-5\times|Ii-Ic|\times(100/P_{interval}(n))) \quad (1)$$

The CPU determines the next magnetic particle replacement timing according to the above-described result.

The formula (1) is an optimized result in a case where the upper limit of the current change |Ii−Ic| is set to be 5% of the initial current Ii (i.e., 0.15 mA) in the configuration of the present exemplary embodiment. Accordingly, if the allowable range for the variable resistance is changed, different experimental data will be obtained in the graph illustrated in FIG. 16. Therefore, it is apparent that the formula (1) is variable. The current change |Ii−Ic| is variable according to the number of output sheets. Therefore, the CPU obtains the next magnetic particle replacement interval $P_{interval}$ using a rate of the preceding $P_{interval}$ as defined in the formula (1).

Considering the phenomenon that flowability and surface properties of the magnetic particles are variable due to their frictions even when no current change is observed, the present exemplary embodiment performs a magnetic particle replacement operation for every 250 sheets at maximum. The present exemplary embodiment sets 100 sheets as an initial interval and performs the replacement operation in a non-image region between sheets. The CPU controls the discharge/supplying operations based on the interval $P_{interval}$ determined as described above. Therefore, if the image forming processing is performed at a higher printing rate, the next magnetic particle replacement is performed at earlier timing. Variations in the resistance of the magnetic particles can be reduced. If the image forming processing is performed at a lower printing rate, the next magnetic particle replacement is performed at later timing. Unnecessary replacement of the agent can be reduced.

An endurance test for outputting $1\times10^5$ sheets of images printed at a printing rate of 3% and an endurance test for outputting $1\times10^5$ sheets of images printed at a printing rate of 100% were conducted. A charging container was filled with magnetic particles of 50 g. The discharge/supplying operations were performed during the endurance tests. The discharge operation requires 44.1 seconds as a time necessary for the particle surface level to reach the position of 10 mm where no current can be detected by the lower electrode. The supplying operation requires 12.5 seconds as a time necessary for the particle surface level to reach the position of 15 mm where the upper electrode can detect current. In other words, a sequential magnetic particle discharge/supplying operation requires approximately one minute.

The time required for the test was 42 hours in a case where the magnetic particle discharge/supplying operation was performed at the constant interval of 100 sheets. In the endurance test of the image output performed with the printing rate of 3%, no substantial change in the charged potential was confirmed. However, in the endurance test of the image output performed with the printing rate of 100%, a change from 485 V (initial value) to 440 V in the charged potential was confirmed. This is believed because a magnetic brush charger operating with the printing rate of 100% is contaminated if the magnetic particle discharge/supplying operation is performed at the constant interval of 100 sheets. Namely, the constant interval of 100 sheets is too low to prevent the magnetic brush charger from contaminating.

The time required for the test was 33 hours in a case where the interval of the magnetic particle discharge/supplying operation is controlled according to the method of the present exemplary embodiment. In the test performed with the printing rate of 3%, no substantial change in the charged potential was confirmed. In the test performed with the printing rate of 100%, a change from 485 V to 475 V in the charged potential was confirmed. The confirmed change is smaller than the change observed in the magnetic particle discharge/supplying operation performed at the constant interval of 100 sheets.

Similar to the first exemplary embodiment, the present exemplary embodiment uses two detection electrodes. If the cumulative number of sheets used for the image forming processing reaches the magnetic particle replacement interval $P_{interval}$, the present exemplary embodiment performs the magnetic particle replacement operation. First, the present exemplary embodiment continuously performs a magnetic particle discharge operation until the magnetic particle surface level falls below the lower electrode. The present exemplary embodiment stops the discharge operation when the lower detection electrode does not detect any current. Then, the present exemplary embodiment starts a magnetic particle supplying operation and continues the supplying operation until the magnetic particle surface level reaches the upper electrode. More specifically, the present exemplary embodiment stops the magnetic particle supplying operation if the upper electrode detects a predetermined current (threshold current) after starting the magnetic particle supplying operation.

Figure 21:
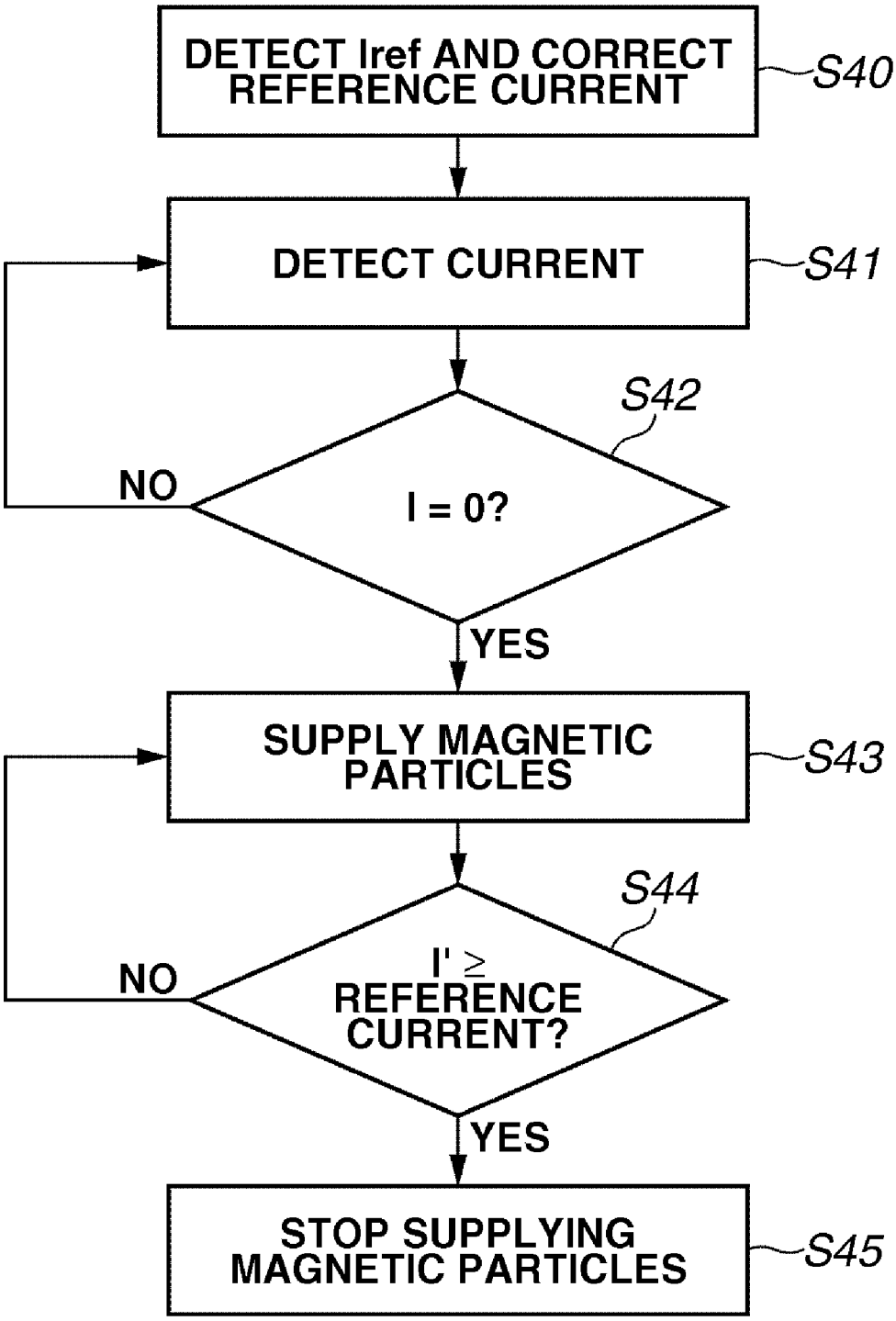
FIG. 21 is a flowchart illustrating example control processing according to the fifth exemplary embodiment.

FIG. 21 is a flowchart illustrating example control for replacing the magnetic particles. In step S51, the CPU 36 sets 100 sheets as an initial replacement interval for the magnetic particles (P0=100). In step S52, the CPU 36 starts outputting images while counting a cumulative number (hereinafter, referred to as "COUNT") of sheets used for image formation. Then, the CPU 36 compares the COUNT with the magnetic particle replacement interval $P_{interval}$ (hereinafter, referred to as "P"). In step S53, the CPU 36 determines whether the COUNT is equal to or greater than P (COUNT ≧P). If the relationship COUNT ≧P is satisfied (YES in step S53), the processing proceeds to step S54.

In step S54, the CPU 36 discharges the magnetic particles at a predetermined speed and performs sampling of the current flowing through the detection electrode simultaneously. In step S555, the CPU 36 determines whether the current I flowing through the lower detection electrode is equal to or less than 0. If the current I becomes 0 (YES in step S55), the processing proceeds to step S56. In step S56, the CPU 36 stops the magnetic particle discharge operation. The CPU 36 obtains a current value (current reduction value Ic) sampled 12.6 seconds before the detected current became zero. In step S57, the CPU 36 calculates a difference between a current reduction value Ii serving as a reference value (3 mA in the present exemplary embodiment) and the obtained Ic ($\Delta=|Ii-Ic|$). In step S58, the CPU 36 obtains the next magnetic particle replacement interval Pn+1 based on the difference $|Ii-Ic|$ and the preceding magnetic particle replacement interval Pn according to the formula (1) and stores the obtained interval Pn+1 in a storage unit.

In step S59, the CPU 36 resets the COUNT (i.e., the cumulative number of sheets used for image formation) to 0. In step S510, the CPU 36 starts a magnetic particle supplying operation. In step S511, the CPU 36 determines whether the current I' flowing through the upper detection electrode is equal to or greater than a threshold current. If the current I' is equal to or greater than the threshold current (YES in step S511), the processing proceeds to step S512. In step S512, the CPU 36 stops the magnetic particle supplying operation.

A sixth exemplary embodiment of the present invention provides a plurality of current detection electrodes (similar to those described in the fifth exemplary embodiment) in the longitudinal direction of the charging device and can accurately detect a deterioration level of magnetic particles when images having different printing rates are output.

Figure 17B:
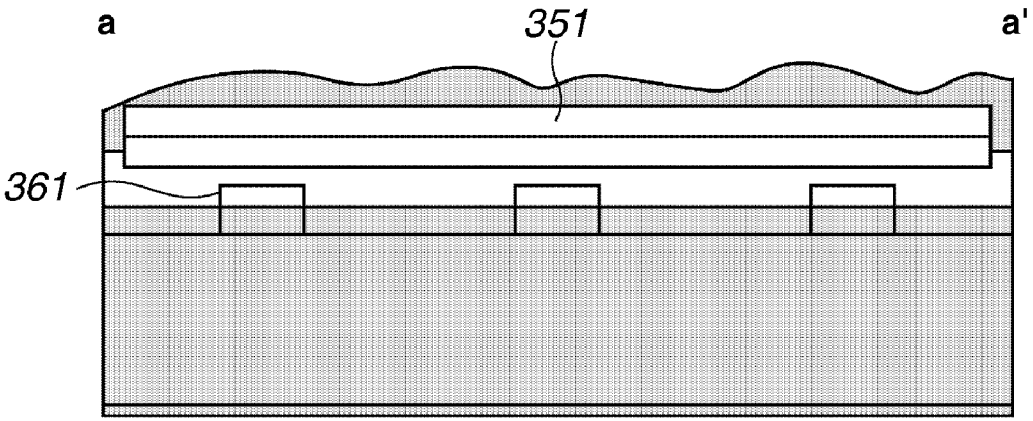
FIGS. 17A and 17B illustrate an example magnetic brush charging device according to a sixth exemplary embodiment.
Figure 17A:
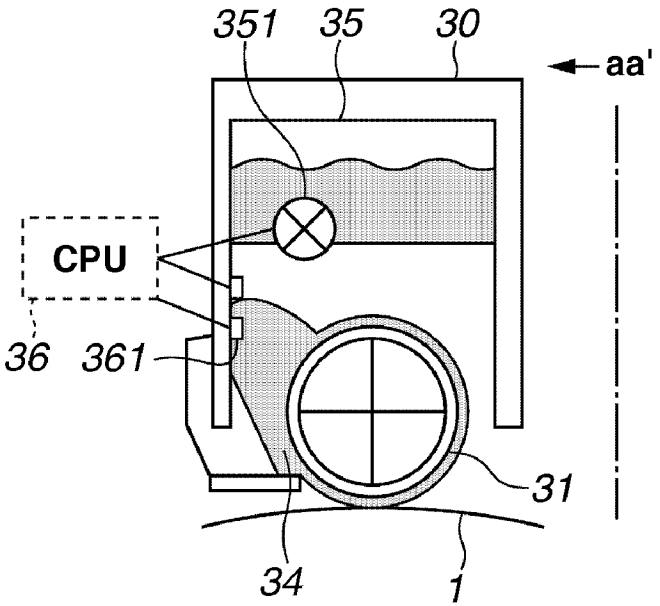

In the present exemplary embodiment, three detection devices similar to those described in the fifth exemplary embodiment are disposed at different (front, center, and rear) positions in the longitudinal direction as illustrated in FIGS. 17A and 17B. Similar to the fifth exemplary embodiment, the present exemplary embodiment causes each detection device to read a reduction rate of the current flowing through the detection electrode 361, which decreases to zero in the discharge operation, and controls the replacement frequency.

The present exemplary embodiment sets the replacement timing based on information obtained from a portion where the magnetic particles are most deteriorated. The present exemplary embodiment calculates the magnetic particle replacement interval $P_{interval}$ according to the formula (1) described in the fifth exemplary embodiment for three detection electrodes provided at the above-described different portions. The present exemplary embodiment performs the next magnetic particle discharge/supplying operation according to a minimum value of the calculated interval $P_{interval}$.

In the present exemplary embodiment, $1\times10^5$ sheets of an image including a solid black printed region having a width of 5 cm at an end in the longitudinal direction with a white printed region (the rest of the image) were output. A deviation in the charged potential was approximately Δ10 V and uniform in each of the solid black printed region and the white background region.

A plurality of supply screws 351 disposed in the longitudinal direction can be provided in the supply device 35. The amount of magnetic particles supplied from each supply screws 351 can be determined according to the current flowing through the electrode disposed at a corresponding position. Therefore, an effect of efficiently agitating the magnetic particles can be obtained by positively supplying new magnetic particles to a portion where the magnetic particles are deteriorated.

If the discharge apparatus is divided into a plurality of sections arrayed in the longitudinal direction, the magnetic particle discharge/supply operation described in the fifth exemplary embodiment can be performed at optimum timing according to a deterioration level of each section. The magnetic particles can be positively discharged if deteriorated and can be used continuously if not deteriorated. Therefore, performing an agent replacement unnecessarily can be prevented. When the image forming apparatus described in any one of the first to sixth exemplary embodiments is used, a maintenance work for replacing the conductive magnetic particles in the charging device becomes unnecessary. The amount of magnetic particles can be stably adjusted.

Figure 13:
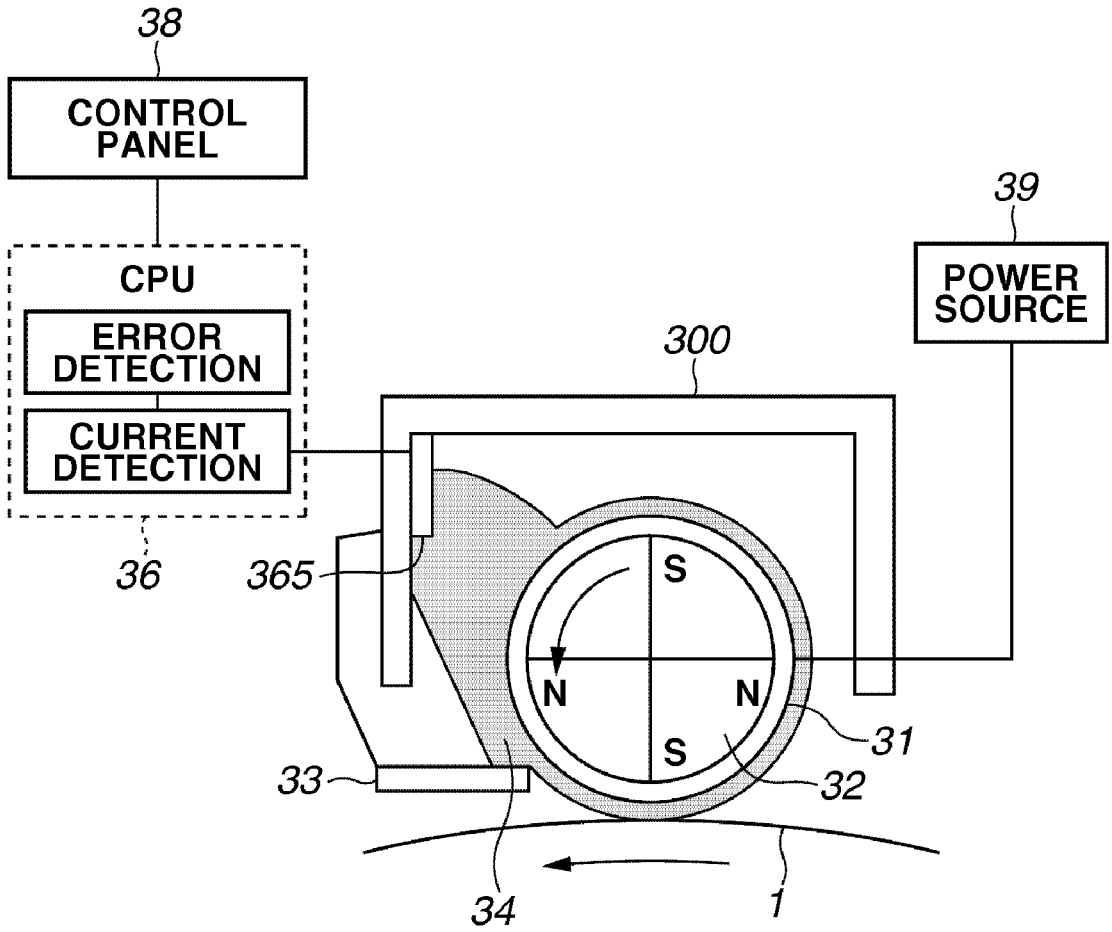
FIG. 13 illustrates an example magnetic brush charging device according to a seventh exemplary embodiment.

A seventh exemplary embodiment of the present invention can bring an effect not related to the replacement of the magnetic particles. FIG. 13 illustrates a magnetic brush charger 300 according to the present exemplary embodiment, which does not include any discharge/supplying unit. The charging device illustrated in FIG. 13 is simple in configuration and can reduce the cost and space, although a replacement of the magnetic particles 34 using the discharge/supplying unit cannot be realized.

In a charging device using a magnetic brush, the magnetic particles 34 may leak out of the charging device due to a disturbance or any trouble caused in the control system. Hence, if a reduction in the amount of the magnetic particles 34 is sensitively detectable, it is possible to generate a warning for a user before a defective coating or insufficient charging occurs due to lack of the magnetic particles 34. In the present exemplary embodiment, a control panel 38 (warning display device) of the image forming apparatus is configured to display an error message (or indication) if the coat is in an unstable state due to reduction of the magnetic particles 34.

Similar to the first to fourth exemplary embodiments, the present exemplary embodiment provides a detection electrode 365 positioned above the regulating blade 33 in a particle pool region. The present exemplary embodiment detects the amount of magnetic particles stored in the particle pool based on the current flowing through the electrode 365, and causes the control panel 38 to display an error message if the coat is in an unstable state (see FIG. 4).

In particular, in a case where no supplying unit is provided as described in the present exemplary embodiment, generating an error message based on a detected amount of magnetic particles is effective. In the above-described first to fourth exemplary embodiments, if a sudden reduction in the amount of magnetic particles is detected in a situation where no discharge operation is performed, such a leakage can be determined as an abnormal leakage of the magnetic particles. Therefore, it is effective to display an error message. Even in an apparatus including both a supplying unit and a discharge unit, it is effective to generate an error message in response to a sudden reduction in the amount of magnetic particles.

Figure 14:
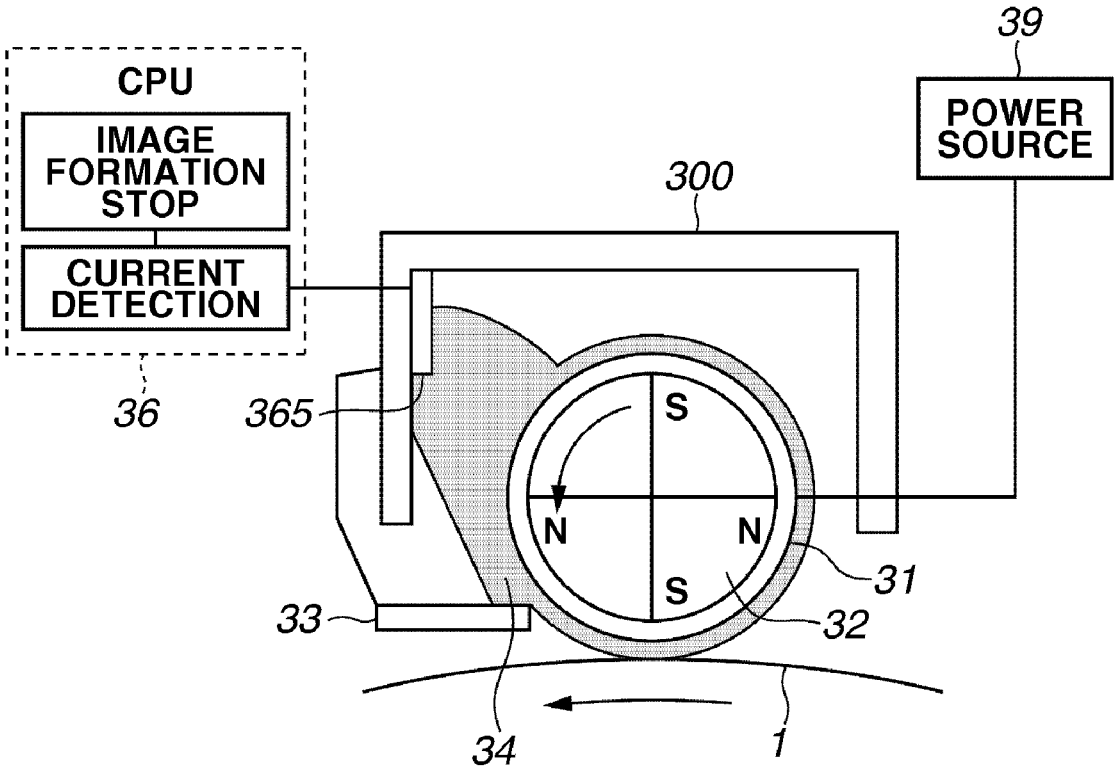
FIG. 14 illustrates an example magnetic brush charging device according to an eighth exemplary embodiment.

An eighth exemplary embodiment of the present invention includes an image formation stopping device configured to stop image forming processing performed by the image forming apparatus if the coat is in an unstable state due to a reduction in the amount of magnetic particles stored in the particle pool. In the present exemplary embodiment, the image formation stopping device is the CPU 36, which is operable as a current detection device. The present exemplary embodiment is effective for the magnetic brush charger 300 illustrated in FIG. 14, which does not include any discharge/supplying unit. The charging device illustrated in FIG. 14 is simple in configuration and can reduce the cost and space, although a replacement of the magnetic particles 34 using the discharge/supplying unit cannot be realized.

Similar to the first to sixth exemplary embodiments, the present exemplary embodiment provides the detection electrode 365 positioned above the regulating blade 33 in a particle pool region. The present exemplary embodiment detects the amount of magnetic particles stored in the particle pool based on the current flowing through the electrode 365, and stops the image forming processing if the coat is in an unstable state (see FIG. 4). Thus, the present exemplary embodiment can eliminate generation of any defective image caused by insufficient charging. Even in an apparatus including both a supplying unit and a discharge unit, it is effective to stop the image forming processing in response to a sudden reduction in the amount of magnetic particles.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application Nos. 2007-328710 filed Dec. 20, 2007 and 2008-285505 filed on Nov. 6, 2008, which are hereby incorporated by reference herein in their entirety.

What is claimed is:

1. An image forming apparatus comprising:

an image bearing member;

a charging device configured to charge the image bearing member, wherein the charging device includes a magnetic particle carrier and a magnetic particle regulating member configured to regulate magnetic particles carried by the magnetic particle carrier, wherein the charging device causes the magnetic particles carried by the magnetic particle carrier to contact the image bearing member, and applies a voltage to the magnetic particle carrier to charge the image bearing member;

an electrode disposed in the charging device and having a contact area via which the electrode can contact magnetic particles stored in a particle pool defined by the magnetic particle carrier and the magnetic particle regulating member, wherein the contact area is variable according to an amount of the magnetic particles stored in the particle pool; and a current detection device configured to detect a value of current flowing from the magnetic particle carrier to the electrode via the magnetic particles.

2. The image forming apparatus according to claim 1, wherein the electrode includes a plurality of electrodes disposed at different positions so that the number of electrodes contacting the magnetic particles is variable according to the amount of magnetic particles stored in the particle pool.

3. The image forming apparatus according to claim 1, wherein the electrode has a shape satisfying a relationship that a length of the electrode in the horizontal direction at a position corresponding to a particle surface level of the particle pool in a case where a larger amount of magnetic particles is stored in the particle pool is longer than a length of the electrode in the horizontal direction at a position corresponding to the particle surface level of the particle pool in a case where a smaller amount of magnetic particles is stored in the particle pool.

4. The image forming apparatus according to claim 1, wherein the charging device includes a magnetic particle supply device configured to supply new magnetic particles to the particle pool, and wherein the image forming apparatus further includes a control device configured to control an amount of magnetic particles supplied from the magnetic particle supply device according to the current value.

5. The image forming apparatus according to claim 4, wherein the magnetic particle supply device is configured to allow the magnetic particles fall into the particle pool via a supply port, and wherein the electrode is positioned on an upstream side from the magnetic particle regulating member and on a downstream side from the supply port in a rotational direction of the magnetic particle carrier.

6. The image forming apparatus according to claim 4, further comprising another electrode disposed in the charging device and having a contact area via which the another electrode can contact the magnetic particles stored in the particle pool, wherein the contact area of the another electrode is not variable depending on the amount of the magnetic particles stored in the particle pool, and wherein the control device is configured to control the amount of the magnetic particles supplied from the magnetic particle supply device according to the value of the current flowing from the magnetic particle carrier to the electrode via the magnetic particles and a value of current flowing from the magnetic particle carrier to the another electrode via the magnetic particles.

7. The image forming apparatus according to claim 4, wherein the control device is configured to control an amount of the magnetic particles supplied from the magnetic particle supply device according to the value of the current flowing from the magnetic particle carrier to the electrode via the magnetic particles and a value of current flowing from the magnetic particle carrier to the image bearing member.

8. The image forming apparatus according to claim 4, wherein the magnetic particle supply device includes a plurality of supply ports disposed in a longitudinal direction of the magnetic particle carrier, wherein the electrode is a plurality of electrodes disposed in the longitudinal direction of the magnetic particle carrier, and wherein the amount of magnetic particles supplied from respective supply ports provided in the longitudinal direction is changed according to the current flowing through the plurality of electrodes provided in the longitudinal direction.

9. The image forming apparatus according to claim 4, wherein the charging device includes a discharge device configured to discharge the magnetic particles carried by the magnetic particle carrier, and wherein the control device is configured to control a discharge amount of the magnetic particles according to the current value.

10. The image forming apparatus according to claim 1, wherein the charging device includes a magnetic particle discharging device configured to discharge the magnetic particles carried by the magnetic particle carrier and a magnetic particle supply device configured to supply new magnetic particles to the particle pool, wherein the magnetic particle discharging device discharges the magnetic particles at a predetermined speed or the magnetic particle supply device supplies the magnetic particles at a predetermined speed, and the current detection device detects the current flowing through the electrode a plurality of times while the contact area between the electrode and the magnetic particles is varying, and determines the next discharge timing or supply timing of the magnetic particle discharging device according to a change amount of the detected current value.

11. The image forming apparatus according to claim 10, wherein the charging device includes a plurality of detection devices configured to detect the electrode disposed in a longitudinal direction of the magnetic particle carrier, and wherein the charging device controls an operation of the magnetic particle discharging device according to the current flowing through the plurality of electrodes provided in the longitudinal direction.

12. The image forming apparatus according to claim 1, further comprising a warning display device configured to display a warning according to the current value detected by the current detection device.

13. The image forming apparatus according to claim 12, further comprising another electrode disposed in the charging device and having a contact area via which the another electrode can contact the magnetic particles stored in the particle pool, wherein the contact area of the another electrode is not variable depending on the amount of magnetic particles stored in the particle pool, and wherein the warning display device is configured to display the warning according to the value of the current flowing from the magnetic particle carrier to the electrode via the magnetic particles and a value of current flowing from the magnetic particle carrier to the another electrode via the magnetic particles.

14. The image forming apparatus according to claim 12, wherein the warning display device is configured to display the warning according to the value of the current flowing from the magnetic particle carrier to the electrode via the magnetic particles and a value of current flowing from the magnetic particle carrier to the image bearing member.

15. The image forming apparatus according to claim 1, further comprising an image formation stopping device configured to stop image formation according to the current value detected by the current detection device.

16. The image forming apparatus according to claim 15, further comprising another electrode disposed in the charging device and having a contact area via which the electrode can contact the magnetic particles stored in the particle pool, wherein the contact area of the another electrode is not variable depending on the amount of magnetic particles stored in the particle pool, and wherein the image formation stopping device is configured to stop image formation according to the value of the current flowing from the magnetic particle carrier to the electrode via the magnetic particles and a value of current flowing from the magnetic particle carrier to the another electrode via the magnetic particles.

17. The image forming apparatus according to claim 15, wherein the image formation stopping device is configured to stop image formation according to the value of the current flowing from the magnetic particle carrier to the electrode via the magnetic particles and a value of current flowing from the magnetic particle carrier to the image bearing member.

* * * * *